US010946239B2

(12) United States Patent
Berry

(10) Patent No.: US 10,946,239 B2
(45) Date of Patent: Mar. 16, 2021

(54) ABDOMINAL EXERCISE CYCLING APPARATUS

(71) Applicant: James Berry, Austell, GA (US)

(72) Inventor: James Berry, Austell, GA (US)

( * ) Notice: Subject to any disclaimer, the term of this patent is extended or adjusted under 35 U.S.C. 154(b) by 0 days.

(21) Appl. No.: 16/847,657

(22) Filed: Apr. 13, 2020

(65) Prior Publication Data

US 2020/0324163 A1 Oct. 15, 2020

Related U.S. Application Data

(60) Provisional application No. 62/833,566, filed on Apr. 12, 2019.

(51) Int. Cl.
*A63B 23/02* (2006.01)
*A63B 22/06* (2006.01)
(Continued)

(52) U.S. Cl.
CPC ..... *A63B 23/0211* (2013.01); *A63B 21/0056* (2013.01); *A63B 21/05* (2013.01); *A63B 21/4035* (2015.10); *A63B 21/4039* (2015.10); *A63B 22/0046* (2013.01); *A63B 22/0605* (2013.01); *A63B 71/0619* (2013.01); *A63B 2022/0652* (2013.01); *A63B 2208/0247* (2013.01); *A63B 2220/62* (2013.01); *A63B 2225/09* (2013.01); *A63B 2230/06* (2013.01)

(58) Field of Classification Search
CPC .. A63B 22/0605–2022/0658; A63B 21/00192; A63B 21/005–0052; A63B 21/0056–0057; A63B 21/4039; A63B 23/0205–0227
See application file for complete search history.

(56) References Cited

U.S. PATENT DOCUMENTS 3,189,344 A * 6/1965 Swarts ..... A63B 22/0005 482/57
3,712,613 A * 1/1973 Feather ..... A63B 23/03525 482/138

(Continued)

FOREIGN PATENT DOCUMENTS

EP 2998005 A1 3/2016
WO 2013168841 A1 11/2013

*Primary Examiner* — Jennifer Robertson
(74) *Attorney, Agent, or Firm* — Bekiares Eliezer LLP

(57) ABSTRACT

A system, method, and apparatus for providing an abdominal exercise cycling apparatus is provided having a body support apparatus, secured to a base apparatus using fasteners, an adjustable lumbar support pad, secured to the base apparatus using a fastener; an anti-slip component, having a friction textured surface configured to interlock with the lower surface of the base apparatus; a stabilizing member, an adjustable member capable of affixing the frame portion in at least one fixed position when the adjustable member is inserted in an aperture comprising a supporting member, the supporting member, providing load bearing support when in the at least one fixed position; a housing covering, a display, having a user interface capable of displaying real-time readings, set in the housing; a resistance apparatus having a contactless eddy brake unit whereby the resistance apparatus utilizing the contactless eddy brake unit to create progressively increasing resistance as speed increases.

20 Claims, 18 Drawing Sheets

(51) Int. Cl.

| | |
|---|---|
| ***A63B 21/005*** | (2006.01) |
| ***A63B 71/06*** | (2006.01) |
| ***A63B 21/00*** | (2006.01) |
| ***A63B 21/05*** | (2006.01) |
| ***A63B 22/00*** | (2006.01) |

(56) References Cited

U.S. PATENT DOCUMENTS 4,538,804 A * 9/1985 Zibell ..... A63B 21/015 482/57
4,717,146 A * 1/1988 Nohara ..... A63B 21/00178 482/62
4,796,882 A * 1/1989 Jiumr ..... A63B 22/0002 482/57
D316,887 S * 5/1991 Lo ..... D21/666
5,038,758 A * 8/1991 Iams ..... A61H 1/008 606/241
5,160,305 A * 11/1992 Lin ..... A63B 23/00 482/138
5,601,515 A * 2/1997 Matsumoto ..... A63B 22/0605 482/57
5,618,247 A * 4/1997 Perez ..... A63B 21/1645 482/60
5,785,631 A * 7/1998 Heidecke ..... A63B 22/001 482/4
6,270,446 B1 * 8/2001 Abelbeck ..... A63B 22/0087 482/51
6,413,192 B2 * 7/2002 Abelbeck ..... A63B 22/0087 482/57
6,500,099 B1 * 12/2002 Eschenbach ..... A63B 21/152 482/121
6,547,701 B1 * 4/2003 Eschenbach ..... A63B 22/001 482/57
6,645,129 B2 * 11/2003 Eschenbach ..... A63B 21/152 482/121
8,113,996 B1 * 2/2012 Allen ..... A63B 22/0605 482/57
8,647,241 B2 * 2/2014 Walton ..... A63B 22/001 482/57
8,696,526 B1 * 4/2014 Dew ..... A63B 22/0605 482/57
8,821,354 B1 * 9/2014 Tabahi ..... A63B 22/0605 482/62
9,044,630 B1 * 6/2015 Lampert ..... A63B 23/04
9,114,278 B1 * 8/2015 Sigel ..... A63B 22/0605
9,233,277 B1 1/2016 Krull
9,545,540 B1 * 1/2017 Moschel ..... A63B 21/4031
2003/0069110 A1 * 4/2003 Chang ..... A63B 21/00069 482/57
2006/0189451 A1 * 8/2006 Nelson ..... A63B 22/0605 482/57
2008/0051274 A1 * 2/2008 Greene ..... A63B 23/0222 482/142
2008/0085822 A1 * 4/2008 Webb ..... A63B 23/0222 482/140
2009/0036274 A1 * 2/2009 Greene ..... A63B 23/0222 482/57
2009/0118099 A1 * 5/2009 Fisher ..... A63B 21/0052 482/5
2011/0234175 A1 * 9/2011 Hajee ..... A63B 22/0007 320/164
2013/0196828 A1 * 8/2013 Kaye ..... A63B 23/0211 482/57
2016/0045383 A1 * 2/2016 Soo ..... A61G 7/015 5/613
2017/0014671 A1 * 1/2017 Burns, Sr. ..... A63B 22/0046
2019/0232098 A1 * 8/2019 Li ..... A63B 21/4035
2019/0308064 A1 * 10/2019 Anderson ..... A63B 22/0605
2020/0171347 A1 * 6/2020 Jiang ..... A63B 22/0605

* cited by examiner

ABDOMINAL EXERCISE CYCLING APPARATUS

RELATED APPLICATIONS

This application claims the benefit of priority to U.S. Provisional Patent Application No. 62/833,566, filed on Apr. 12, 2019, the contents of which is incorporated herein by reference in its entirety.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to an exercise apparatus for conditioning cardiovascular systems, body limbs and muscles.

BACKGROUND OF THE DISCLOSURE

An exercise apparatus is a device for conditioning the cardio-vascular system, for training agility, or coordination of movements with one or more elements. Various types of exercise apparatuses may be configured to provide movement around a particular axis targeting a specific type of muscular development. An exercise apparatus may be specially adapted for developing or strengthening the muscles or joints of the body by working against a counterforce, with or without measuring devices using frictional force resisters including rotating or oscillating elements rubbing against fixed elements. An exercise apparatus may involve movements involving the exercising of arms by simultaneously exercising arms and legs. These movements may include diagonal motion in antiphase wherein exercises for arms and legs can be functionally independent. Exercise activity involving an exercise apparatus may include coordination of movements with support elements performing a rotating cycling movement. An exercise apparatus may also include activity involving a closed path movement performing a circular movement in conjunction with stationary or active movement of one or more body parts. An exercise apparatus may be configured for stretching, bending, or torsioning by utilizing rotating cycling movement. This exercise apparatus may also utilize stretching, bending, and torsioning to exercise upper and/or lower limbs. In some cases, an exercise apparatus may incorporate any combination of the aforementioned features to provide improved methods of conditioning. In other cases, new exercise apparatuses may be developed offering more effective conditioning results and/or improved functionality.

BRIEF OVERVIEW

An abdominal exercise cycling apparatus may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

According to various aspects, the present disclosure provides an abdominal exercise cycling apparatus. In further aspects, the abdominal exercise cycling apparatus may provide for optimal exercise effectiveness allowing the upper torso to remain in a stationary position during a resistance pedaling exercise activity. In still further aspects, the abdominal exercise cycling apparatus may relieve the lower back strain by providing a lumber support pad for the lower back and a body pad for reliving tail bone discomfort. In yet further aspects, an exercise cycling apparatus in accordance with the present disclosure also ensures the correct lower body position is maintained for efficiency and effectiveness for improved fitness results.

According to some implementations, an abdominal exercise cycling apparatus may include a body support portion. The body support portion may include a body pad which may be secured to a base portion using a plurality of fasteners, the body support portion may include an adjustable lumbar support pad which may be secured to the base portion using one or more fasteners. The base portion may be disposed on a level surface. The base portion may have an anti-slip component. The anti-slip component may have a friction textured upper surface configured to interlock with the lower surface of the body support portion, The base portion may include a stabilizing member. The stabilizing member may provide a rigid connection between the anti-slip component and a frame portion. The frame portion may include an adjustable member capable of holding the frame portion in at least one fixed position. The adjustable member may be inserted in an aperture comprising a supporting member. The supporting member may provide load bearing support when in the at least one fixed position.

In further aspects, the supporting member may include an outer cover portion. The outer cover portion may have a housing. The housing may cover the frame portion. The cover may be attached to the housing using one or more fasteners. The outer cover may include a display for real-time readings of a user's vital signs. The display may include a user interface. The display may be set in the housing.

In still further aspects, the abdominal exercise cycling apparatus may include a resistance portion. The resistance portion may have a contactless eddy brake assembly. The contactless eddy brake assembly may have a magnet assembly. The magnet assembly can include a pair of opposing magnets. The pair of opposing magnets may reside within two-cylinder components. The two-cylinder components may be positioned on opposing sides of a motor. The motor may include a motor box which may be positioned to contact a gear track. The motor, motor box, and gear track may collectively form a gear assembly. The gear assembly may be positioned between the magnetic field of the pair of opposing magnets of the magnet assembly. The magnet assembly and gear assembly may be positioned about a pedal assembly. The pedal assembly may include a crank arm. The crank arm may include a foot rest. The crank arm and foot rest may rotate about a radial axis. The crank arm and foot rest may propel a wheel disk in a cyclical motion. The resistance portion may utilize the contactless eddy brake assembly in a manner that creates progressively increasing resistance as speed increases.

According to other implementations, a method of the present disclosure may include adjusting a body support portion of an exercise apparatus to an appropriate exercise position having a predetermined height and angle. A frame portion of the exercise apparatus may be adjusted to the appropriate exercise position by securing a stabilizing member to hold the appropriate exercise position. One or more settings of a user interface of a display of the exercise apparatus may be selected including at least time period of exercise and/or level of exercise resistance. A user, such as person, may place their feet in a foot stirrup of a pedal assembly while placing torso in a supine position on the body support portion. A person may pedal the pedal assembly with force in a cycling motion against a resistance generated by a contactless eddy braking assembly. A person may increase intensity of the exercise by interlocking fingers behind the head while pedaling with elbows in an outward position. A person may additionally perform advanced movements including elevating the neck and shoulders holding a shoulder backward press assembly while pedaling continuously. Furthermore, a person may further enhance the intensity of exercise performance by lowering the neck and shoulders back against a resistance generated by a spring support of the shoulder backward press assembly.

According to still other implementations, a disclosed exercise apparatus or system may include a body support apparatus. The body support apparatus may have a body pad which may be secured to a base apparatus using a plurality of fasteners. The body support apparatus may include an adjustable lumbar support pad. The adjustable lumbar support pad may be secured to the base apparatus using a fastener. The base apparatus may be disposed on a level surface. The base apparatus may be connected to an anti-slip component. The anti-slip component may include a friction textured surface configured to interlock with the lower surface of the body support apparatus. The body support apparatus may include a stabilizing member. The stabilizing member may provide a rigid connection between the anti-slip component and a frame apparatus. The frame apparatus may include an adjustable member. The adjustable member may hold the frame apparatus in at least one fixed position when the adjustable member is inserted in an aperture comprising a supporting member. The supporting member may provide load bearing support when in the at least one fixed position. The system may include an outer cover apparatus. The outer cover apparatus may include a housing. The housing may cover the frame apparatus upon being attached using one or more fasteners. The housing may house a display. The display may include a user interface capable of displaying real-time readings. The system may include a resistance apparatus. The resistance apparatus may include a contactless eddy brake unit. The contactless eddy brake unit may include a magnet assembly. The magnet assembly may include a pair of opposing magnets. The pair of opposing magnets may be housed within two-cylinder components on opposing sides of a motor. The motor may be housed in a motor box. The motor in the motor box may contact a gear track. The motor, motor box, and gear track may form a gear assembly. The gear assembly may be positioned between the magnetic field of the pair of opposing magnets of the magnet assembly. The magnet assembly and gear assembly may be positioned about a pedal assembly. The pedal assembly may include a crank arm connected to a foot rest or stirrup. The pedal assembly may propel a wheel disk having a disk cover in a cyclical motion. The resistance apparatus may utilize the contactless eddy brake unit operationally connected to the pedal assembly. The connection of these two components may cause progressively increasing resistance to be added to the system as speed increases. The system may include a shoulder backward press unit. The shoulder backward press unit may include a head rest connected to a shoulder support member. The shoulder support member may have a plurality of arm supporting pads. The shoulder backward press unit may include a spring support contacting the base apparatus.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are explanatory only and are not restrictive of the disclosure, as claimed.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE DISCLOSURE

Figure 1A:
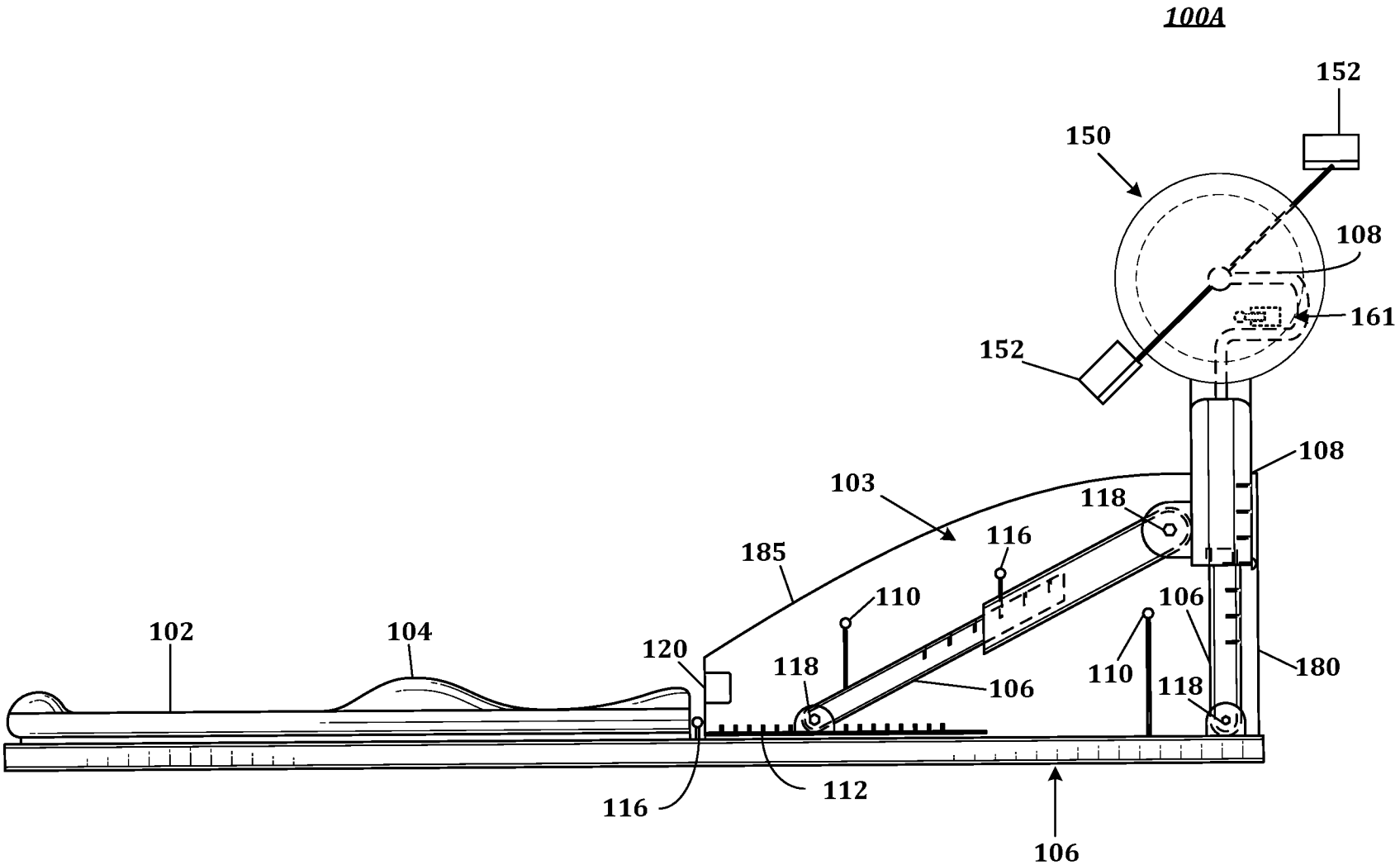
FIGS. 1A-1F are diagrams of an example implementation of an abdominal exercise cycling apparatus in accordance with an embodiment of the present disclosure.

The present disclosure includes many aspects and features. Moreover, while many aspects and features relate to, and are described in, the context of abdominal exercise cycling apparatus for cosmetics, embodiments of the present disclosure are not limited to use only in this context. The present disclosure can be understood more readily by reference to the following detailed description of the disclosure and the examples included therein.

Before the present articles, systems, apparatuses, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

As used herein, a "frame member" may refer to at least one of but is not limited to: a track ridge, an outer metal frame, an inner metal frame, a rod tube, a railing, a cross bar support, an elongated fork, an elongated C-shaped fork, and other elongated members of various lengths, shapes, and materials.

As used herein, a "stabilizing member" may refer to at least one of but is not limited to: a male threaded rod, swivel out legs, a cross support bar, a swivel wheel angle bar, a fork separation rod, a male vertical bar, a threaded leg, a T-shaped male vertical bar, a T-shaped threaded leg, and other elongated members of various lengths, shapes, and materials.

As used herein, an "adjustment member" may refer to at least one of but is not limited to: a release knob, a spring-loaded knob, a knob tethered to a frame, and other elongated members of various lengths, shapes, and materials.

As used herein, a "fastener" may refer to at least one of but is not limited to: a screw, a bolt, an attachment screw, a flat head screw, a frame bolt, a frame nut, a locking washer, a rubber washer, a locking nut washer, a connecting bolt, a wing nut, a self-locking nut, a rubber insert for a bolt and nut, an open square band bolt, a bearing, a bearing washer, a rod bearing, a center screw, a hex bolt, a locking nut, a locking nut cap, an elongated screw, an installations screw, a connector plate, a connector bolt, a pin connector, a rotating connector, a belt, a chain, a link, a gear connector, and other fastening elements, junction points, and connecting apparatuses of various lengths, shapes, and materials.

As used herein, an "aperture" may refer to at least one of: metal rings, threaded openings, hollow spaces, support openings, and receiving apertures or receptacle spaces for accepting connecting point of frame members, stabilizing members, adjustment members, other elongated members of various lengths, shapes, materials, fasteners, and the like.

Any suitable materials may be used for the abdominal exercise cycling apparatus, its members, elements, components, fasteners and the like. Materials including but not limited to: plastic, steel, metals, commercial grade plastic, industrial grade steel, metal, rubber, polypropylene, silicone, alloy steel, aluminum, brass, copper, bronze, stainless steel, titanium, zinc, black Acrylonitrile Butadiene Styrene (ABS), acrylic, acetal, nylon, polycarbonate, polytetrafluoroethylene (Teflon), ultra-high molecular weight polyethylene (UHMW PE), plastics, synthetic materials, and the like. In some instances, materials including but not limited to: alloy steel, aluminum, brass, silicon bronze, and stainless steel are used to manufacture members and fasteners including additional treatments for coating, plating, and hardening materials to improve grade and strength. Any of the suitable materials which may be used for the abdominal exercise cycling apparatus, its members, elements, components, fasteners and the like may also use appropriate lubrication and cooling elements including but not limited to: metal based anti-seize lubricant; being composed of assorted mixtures of aluminum, copper, graphite and nickel powders in a grease base—that allows repeated assembly and disassembly without wear and the elimination of fretting corrosion during use.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed apparatuses, systems, and articles of the disclosure as well as the apparatuses themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and apparatuses of the disclosure. Thus, if there are a variety of additional steps that can be performed it is understood that each of these additional steps can be performed with any specific aspect or combination of aspects of the methods of the disclosure.

It is understood that the apparatuses and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

The following detailed description of example implementations refers to the accompanying drawings. The same reference numbers in different drawings may identify the same or similar elements.

Consistent with embodiments of the present disclosure, an abdominal exercise cycling apparatus may be provided. This introduces a selection of concepts in a simplified form that are further described below. This overview is not intended to identify key features or essential features of the claimed subject matter. Nor is this overview intended to be used to limit the claimed subject matter's scope.

Using an exercise apparatus, a person may desire to exercise abdominals to improve core strength or attain better overall health. In some situations, a user may desire to perform sit ups, modified "crunches", and other abdominal exercises for this purpose. In other instances, a person may desire to use an exercise apparatus for developing or strengthening the muscles or joints of the body by working against a counterforce. In yet other instances, a person may desire to exercise to achieve improved cardio vascular health. For example, a person may perform aerobic activity such as running, jogging, aerobics, high intensity interval training, for cardiovascular results. In another instance, a person may desire to perform various abdominal exercises targeting the rectus abdominis, transversus abdominis, internal and external obliques. The conventional strategy may be to apply one or more workout regimens, hire a personal trainer, or join a gym where these activities can be guided by a professional. While this may be optimal, this is not always possible. For example, someone may desire to improve their health through exercise but their weight, strength, or endurance may not yet be of a level acceptable to perform exercise with that level of intensity or consistency. This often causes problems because in addition to lacking a particular level of fitness, a person may also lack the confidence to exercise in public places including gyms, parks, trails, and roadways. The person may also have pain throughout the body. For instance, a person may have pain in the lumbar region of the lower back and tailbone, in the knee joints of the legs, or have weak joints in the wrists or hands. Additionally, the common up and down motion of the torso for resistance weight to the abdomen may cause added pain and discomfort. Exercising using an incorrect body position does not allow for maximum efficiency and limits the amount of resistance that can be applied during exercise. Exercising in any incorrect position also limits the effectiveness of working out and reaching desired fitness goals and objectives. Incorrect positioning of the body during exercise also creates more opportunities for injury, pain and discomfort. Experiencing repeated intense discomfort while exercising reduces the amount of time and frequency a person would spend on exercise thereby limiting the results.

Accordingly, there remains a need for an improved apparatus and method for improving core strength, cardiovascular fitness, and tone muscles. This need and other needs are satisfied by the various aspects of the present disclosure. The abdominal exercise cycling apparatus relieves lower back discomfort derived from the repeated up and down motion of the upper body sustained during traditional sit ups. The abdominal exercise cycling apparatus alleviates the strain on the lower back and tail bone pain often associated with abdominal exercises. The abdominal exercise cycling apparatus does not require the constant movement of the torso up and down for an effective abdominal exercise. The abdominal exercise cycling apparatus may provide effective engagement of the core in a manner that does not intensify discomfort.

The abdominal exercise cycling apparatus provides improved functionality of movement, in at least one implementation, by allowing the upper torso to remain in a stationary supine position during a resistance pedaling exercise activity. The abdominal exercise cycling apparatus helps relieve lower back strain by providing a conformed lower back lumber support pad and a body pad for relieving tail bone discomfort. The abdominal exercise cycling apparatus also ensures the correct lower body position is maintained for efficiency and effectiveness for gaining more efficient exercise results.

The abdominal exercise cycling apparatus also includes, in at least one implementation, a shoulder backward press apparatus. The shoulder backward press apparatus allows a person to use a negative resistance by pressing in a backwards direction and causing muscle contraction of the abdominal area. This exercise motion offers an alternative mode of operation for a person that may not be able to raise and hold their shoulders off the mat during a standard mode of operation. The shoulder backward press apparatus also provides a mechanism for a person to benefit from the use of a negative resistance while optionally performing a cardio, leg pressing exercising motion with the legs. The abdominal exercise cycling apparatus provides an angle of operation and a supportive lumbar support for a person in a supine position such that it relieves lower back pressure.

FIGS. 1A-1F are diagrams of example implementations 100A-100F described herein of the abdominal exercise cycling apparatus. For example, example implementation 100A may include an abdominal exercise cycling apparatus in an upright position as described herein. As shown in FIG. 1A, body pad 102 may be positioned at the anterior end of abdominal exercise cycling apparatus 100A. An adjustable lumbar support pad 104 is proximal to the body pad 102. Both the body pad 102 and the adjustable lumbar support pad 104 may be secured to a frame member 106 by one or more fasteners 110 and one or more adjustment members 116. Body pad 102 and adjustable lumbar support pad 104 are disposed horizontally and coplanarly to a frame member 106. In at least one implementation, body pad 102 and adjustable lumbar support pad 104 are disposed horizontally and coplanarly on a level stabilizing surface such as a floor. Frame members 106 are supported by a floor or horizontal surface inferior to the abdominal exercise cycling apparatus 100A. In one or more implementations, body pad 102 and adjustable lumbar support pad 104 be connected to an anti-slip component 114, as further detailed in FIGS. 2C-2E. The anti-slip component 114 may include a friction textured surface configured to interlock with the lower surface of the body support apparatus comprising the body pad 102 and adjustable lumbar support pad 104. The anti-slip component 114 may be used to prevent the body pad 102 and adjustable lumbar support pad 104 slipping out of position during operation. The combination of fasteners 110, fastener receiving apertures 112, frame members 106, stabilizing members 108, and adjustment members 116, are used to secure the various components and members together in a manner providing distance from the frame that allows the abdominal exercise cycling apparatus 100A to have the flexibility of adjustable positions and the sturdiness of being locked into place during operation. The combination of fasteners 110, fastener receiving apertures 112, frame members 106, stabilizing members 108, and adjustment members 116 may be used to stop the entire abdominal exercise cycling apparatus 100 from flipping over during operation.

In at least one implementation, a body support apparatus may include a body pad 102 which may be secured to a base apparatus comprising one or more frame members 106, which may be secured using a plurality of fasteners 100. The base apparatus may have the anti-slip component 114. The anti-slip component 114 may have a friction textured upper surface configured to interlock with the lower surface of the body support apparatus, the base apparatus may include a stabilizing member 108. The stabilizing member may provide a rigid connection between the anti-slip component 114 and a frame member 106. In at least one implementation, a stabilizing member 108 which may have one or more apertures 112, the one or more apertures 112 positioned to accept one or more adjustment members 116, and at least one fastener 110, the fastener rigidly secured to an aperture 112 of the anti-slip component 114. The frame apparatus 103 may include an adjustment member 116 that can be capable of holding the frame member 106 in at least one fixed position.

As shown in FIG. 1A, 100A, the abdominal exercise cycling apparatus is shown in the upright fixed position further described as follows. At the end posterior to the body pad 102, a vertically positioned frame member 106 is perpendicularly connected via a rotating pin connection 118 to a horizontally positioned frame member 106. The vertically positioned frame member 106 may have one or more apertures 112, the apertures adapted to receive one or more adjustment members 116. In at least one implementation, the vertically positioned frame member 106 may be connected to a stabilizing member 108.

In at least one implementation, the body pad 102 may include a plurality of apertures 112 for receiving one or more fasteners 110. The one or more fasteners 110 securing the body pad 102 to the anti-slip component 114. The anti-slip component 114 may include a flat metal piece connecting the two together. The body pad 102 fasteners 110 connect to at least one aperture 112 positioned at the posterior of the anti-slip component 114. The fastener 110 slides into posterior aperture 112 that may be built into the rear of a frame member 106. The anti-slip component 114 is secured by an adjustment member 116. This may allow persons of different heights to use abdominal exercise cycling apparatus 100A at a desired optional position.

In at least one implementation, an additional cushion or pad 180 may be fastened to the vertically positioned stabilizing member 108 and vertically positioned frame member at the posterior end of the abdominal exercise cycling apparatus 100A.

In at least one implementation, the stabilizing member 108 may provide a stabilizing base of support for a cycling resistance apparatus 150 connected by one or more fasteners 110 and stabilizing members 108 securing the cycling resistance apparatus 150 in a stabile locked perpendicular position. In at least one implementation, the cycling resistance apparatus 150 is affixed to a stabilizing member 108 connected about a focus of a wheel disk where the stabilizing member 108 is a fork assembly. The cycling resistance apparatus 150 having a pedaling unit 152. The cycling resistance apparatus 150 may be circular or disk shaped. The cycling resistance apparatus may include a wheel disk having a focus at its center equidistant from the points on the outer surface of the wheel disk. In at least one implementation, the wheel disk may include one or more disk fan blades which provide cooling wind or airflow in the direction of the rotating motion of the cycling resistance apparatus 150. In at least one implementation, the wheel disk is covered in a manner such that it may be enclosed. The cycling resistance apparatus 150 may utilize the contactless eddy brake assembly 161 in a manner that creates progressively increasing resistance as speed increases based on the motion of the pedaling unit 152.

In at least one implementation, the vertically positioned stabilizing member 108 may be medially connected to a rotating pin connection 118. The rotating pin connection 118 securing a stabilizing member 108 via an adjustment member 116 to another stabilizing member 108 connected to another rotating pin connection 118 via one or more fasteners 110, where the connection of the stabilizing members 108 between the two rotating pin connections 118 may be at a forty-five-degree angle. In one or more implementations, these interconnected stabilizing members 108 may be one stabilizing member 108. The interconnected stabilizing members may be further secured to a frame member 106.

In at least one implementation, the aforementioned adjustment member 116 may be is inserted in an aperture 112 comprising a frame member 106. The frame member 106 may be provide load bearing support when in the at least one fixed position, herein the upright position. The interconnected members may include a housing 185. The housing 185 may cover the aforementioned interconnected members, rotating pin connections 118, and the like. The housing 185 may be attached to the interconnected members using one or more fasteners 110 via. The housing 185 may include a display 120. In at least one implementation, the display 120 may include but not be limited to: a user interface, real-time readings of a user's vital signs, a reset button, a speed indicator, a heart rate indicator, a calorie expenditure rate indicator, a total caloric expenditure indicator, a distance indicator, a time involved indicator, a resistance setting input, notifications, social media status updates, alerts, calendar notifications, text messages, images, videos, recordings, television programs, movies, entertainment, and other readings or display information. In at least one implementation, the display 120 may be powered by a power supply including but not limited to a battery, a solar power source, an alternating current source, a direct current source, a power generated by the centrifugal motion of the abdominal exercise cycling apparatus 100A. In at least one implementation, the display 120 may include a wireless connection to a computer, a processor, a smart phone, an IoT enabled device, a smart watch, a sensor, a body sensor, a heart rate monitor, and the like. In at least one implementation, the display 120 may include data from an electronic medical records database, a wireless connection to a medical professional, a button alerting emergency medical personnel/first responders/paramedics. In at least one implementation, there may be one or more displays 120. In at least one implementation, the display 120 may be set in the housing 185 in one or more positions within the housing 185.

Figure 1B:
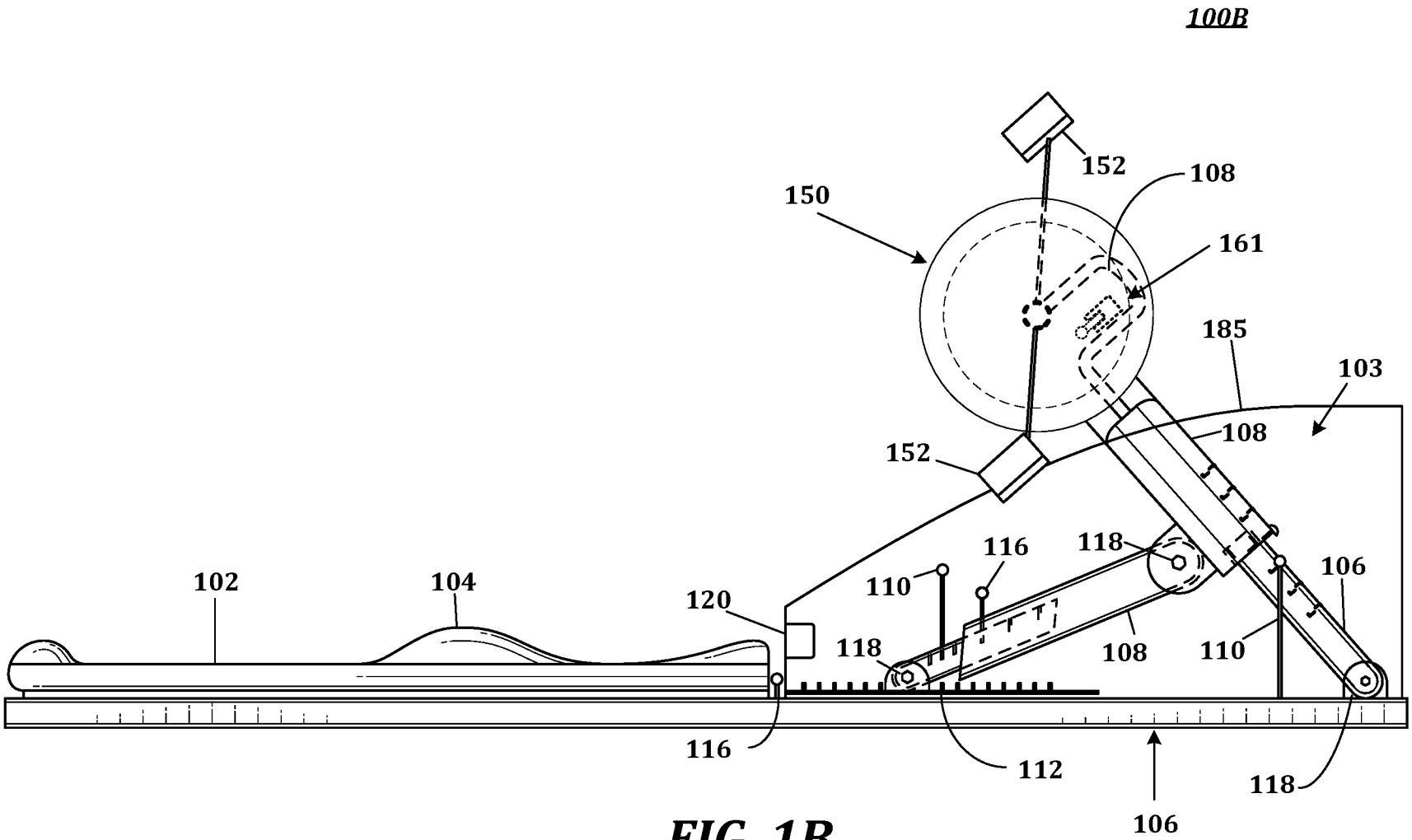

For example, example implementation 100B may include an abdominal exercise cycling apparatus 100A as described completely in FIG. 1A with the exception of FIG. 1B, 100B showing the abdominal exercise cycling apparatus in an acute fixed position. As shown in FIG. 1B, and by reference number 100B, the abdominal exercise cycling apparatus 100 is adjustable to one or more fixed positions including an upright position as shown in FIG. 1A, 100A, an acute position as shown in FIG. 1B, 100B, and a collapsed position shown in FIG. 1C, 100C. Moving the abdominal exercise cycling apparatus 100 from an upright position of complete vertical as shown in FIG. 1A, 100A, the cycling resistance apparatus 150 may tilted downward a maximum of forty-five degrees by adjusting the vertically positioned frame member 106 formally perpendicularly connected via a rotating pin connection 118 to an acute angled positioned when compared with the horizontally positioned frame member 106.

In at least one implementation, the angled positioned stabilizing member 108 may be medially connected to a rotating pin connection 118. The rotating pin connection 118 securing a stabilizing member 108 via an adjustment member 116 to another stabilizing member 108 connected to another rotating pin connection 118 via another adjustment member 116 where the connection of the stabilizing members 108 between the two rotating pin connections 118 may be at a varied angle. In one or more implementations, these interconnected stabilizing members 108 may be one stabilizing member 108. The interconnected stabilizing members may be further secured to a frame member 106. These stabilizing members 108 and frame members 106 of a lower section of the vertical arm portion of the abdominal exercise cycling apparatus 100 may be rotated about a rotating pin connection 118 allowing the vertical arm portion and cycling resistance apparatus 150 to be adjustable to a variety of angles.

This acute fixed position of the abdominal exercise cycling apparatus 100B may change the associated workout intensity levels. The cycling resistance apparatus 150 may be removed and repositioned using a pin in hole system at the focus point of the wheel disk. This may allow the abdominal exercise cycling apparatus 100 to be used by individuals of varying heights and sizes.

Figure 1C:
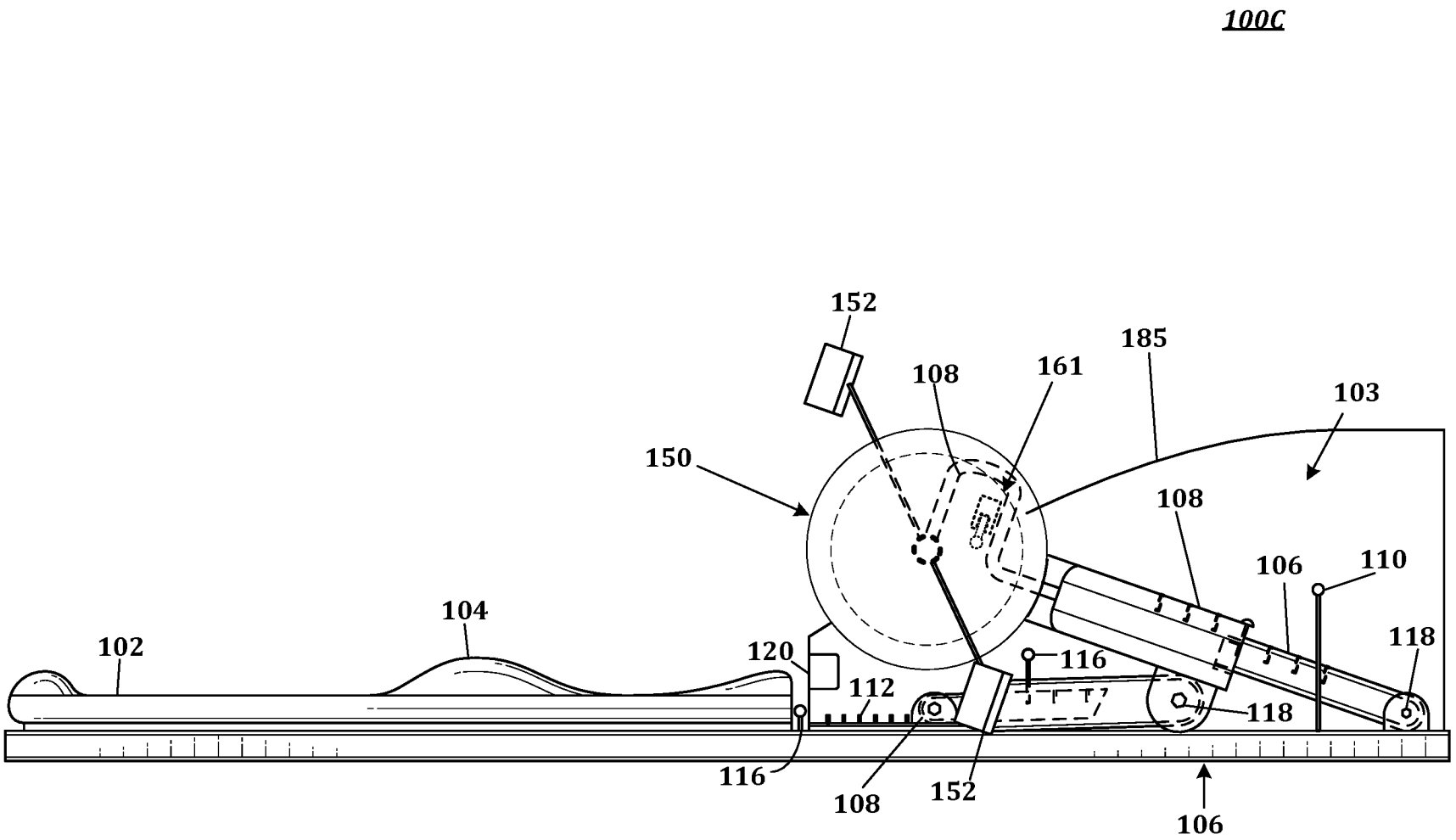

For example, example implementation 100C may include an abdominal exercise cycling apparatus 100A as described completely in FIG. 1A with the exception of FIG. 1C, 100C showing the abdominal exercise cycling apparatus in a collapsed fixed position for stowing. As shown in FIG. 1C, and by reference number 100C, moving the abdominal exercise cycling apparatus 100 from an upright position of complete vertical as shown in FIG. 1A, 100A, the cycling resistance apparatus 150 may tilted downward an extreme acute angle less than forty-five degrees by adjusting the vertically positioned frame member 106 formally perpendicularly connected via a rotating pin connection 118 to an extremely acute angled positioned when compared with the horizontally positioned frame member 106.

In at least one implementation, the angled positioned stabilizing member 108 may be medially connected to a rotating pin connection 118. The rotating pin connection 118 securing a stabilizing member 108 via an adjustment member 116 to another stabilizing member 108 connected to another rotating pin connection 118 via another adjustment member 116 where the connection of the stabilizing members 108 between the two rotating pin connections 118 may be at an extremely acute varied angle. In one or more implementations, these interconnected stabilizing members 108 may be one stabilizing member 108. The interconnected stabilizing members may be further secured to a frame member 106. These stabilizing members 108 and frame members 106 of a lower section of the vertical arm portion of the abdominal exercise cycling apparatus 100 may be rotated about a rotating pin connection 118 allowing the vertical arm portion and cycling resistance apparatus 150 to be adjustable to an extremely acute angle. In at least one implementation, the body pad 102, adjustable lumbar support pad, and frame member 106 may be further collapsible or removable from a frame member 106 for stowing. In at least one implementation, the pedaling unit 152 may include collapsible or removable pedals and cranks for stowing.

Figure 1D:
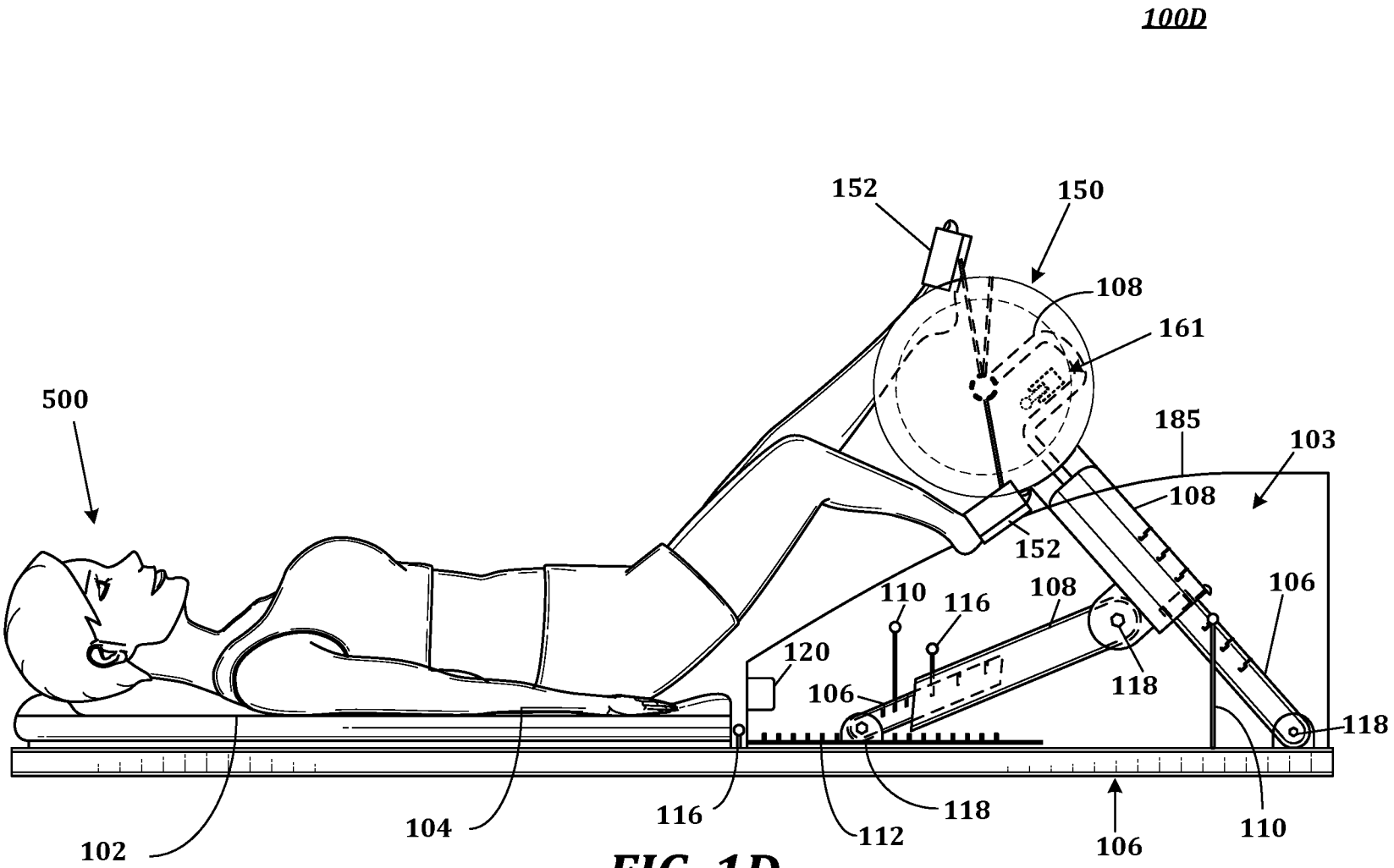

For example, example implementation 100D may include an abdominal exercise cycling apparatus 100A as described completely in FIG. 1A with the exception of FIG. 1D, 100D showing the abdominal exercise cycling apparatus in an acute fixed position as shown in FIG. 1B, 100B. As shown in FIG. 1D, and by reference number 100D, a person in a supine position 500 may be actively engaged with the pedaling unit 152. The person 500 may further engage the pedaling unit with their feed and rotational movement. The person 500 may utilize the contactless eddy brake assembly 161 in a manner that creates progressively increasing resistance as speed increases based on the motion of the pedaling unit 152. In this manner, a person 500 may control resistance using the contactless eddy brake assembly 161 such that the resistance may be directly proportional to the force exerted on the pedaling unit 152. The person 500 may engage the display 120.

In at least one implementation, the person 500 may utilize the display 120 for at least one of: a user interface, real-time readings of a user's vital signs, a reset button, a speed indicator, a heart rate indicator, a calorie expenditure rate indicator, a total caloric expenditure indicator, a distance indicator, a time involved indicator, a resistance setting input, notifications, social media status updates, alerts, calendar notifications, text messages, images, videos, recordings, television programs, movies, entertainment, and other readings or display information. In at least one implementation, the person may engage the display 120 utilizing at least one of: a wireless connection to a computer, a processor, a smart phone, an IoT enabled device, a smart watch, a sensor, a body sensor, a heart rate monitor, and the like. In at least one implementation, the display 120 may sync to a device, a smart device, and other equipment via a wireless connection including but not limited to infrared, light frequencies, sound waves, computer readable mediums, a Bluetooth connection, a Wi-Fi connection. In at least one implementation, the display 120 is connected to a transmitter or communication means, transmitting medium, and other receiving and transmitting means. In at least one implementation, the person 500 may utilize the display 120 to communicate at least one of: receive data from an electronic medical records database, a wireless connection to a medical professional, a button alerting emergency medical personnel/first responders/paramedics. In at least one implementation, a person may engage with one or more displays 120.

Figure 1E:
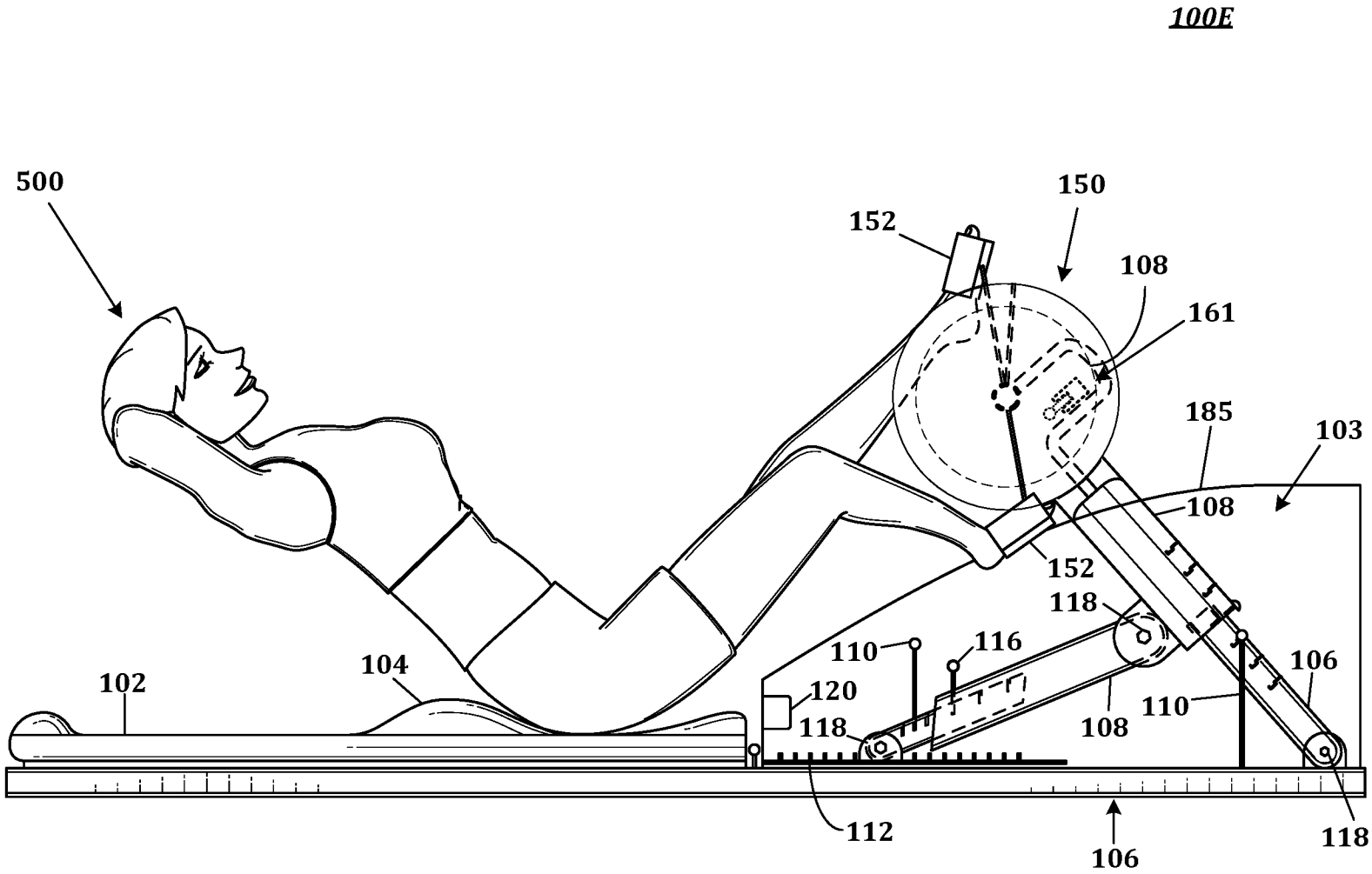

For example, example implementation 100E may include an abdominal exercise cycling apparatus 100A as described completely in FIG. 1A-1D with the exception of FIG. 1E, 100E showing a person 500 using the abdominal exercise cycling apparatus in an acute fixed position. As shown in FIG. 1E, and by reference number 100E, a person 500 may increase intensity of the exercise by interlocking fingers behind the head while pedaling with elbows in an outward position in an elevated supine position where the upper torso may be elevated engaging the core muscles.

Figure 1F:
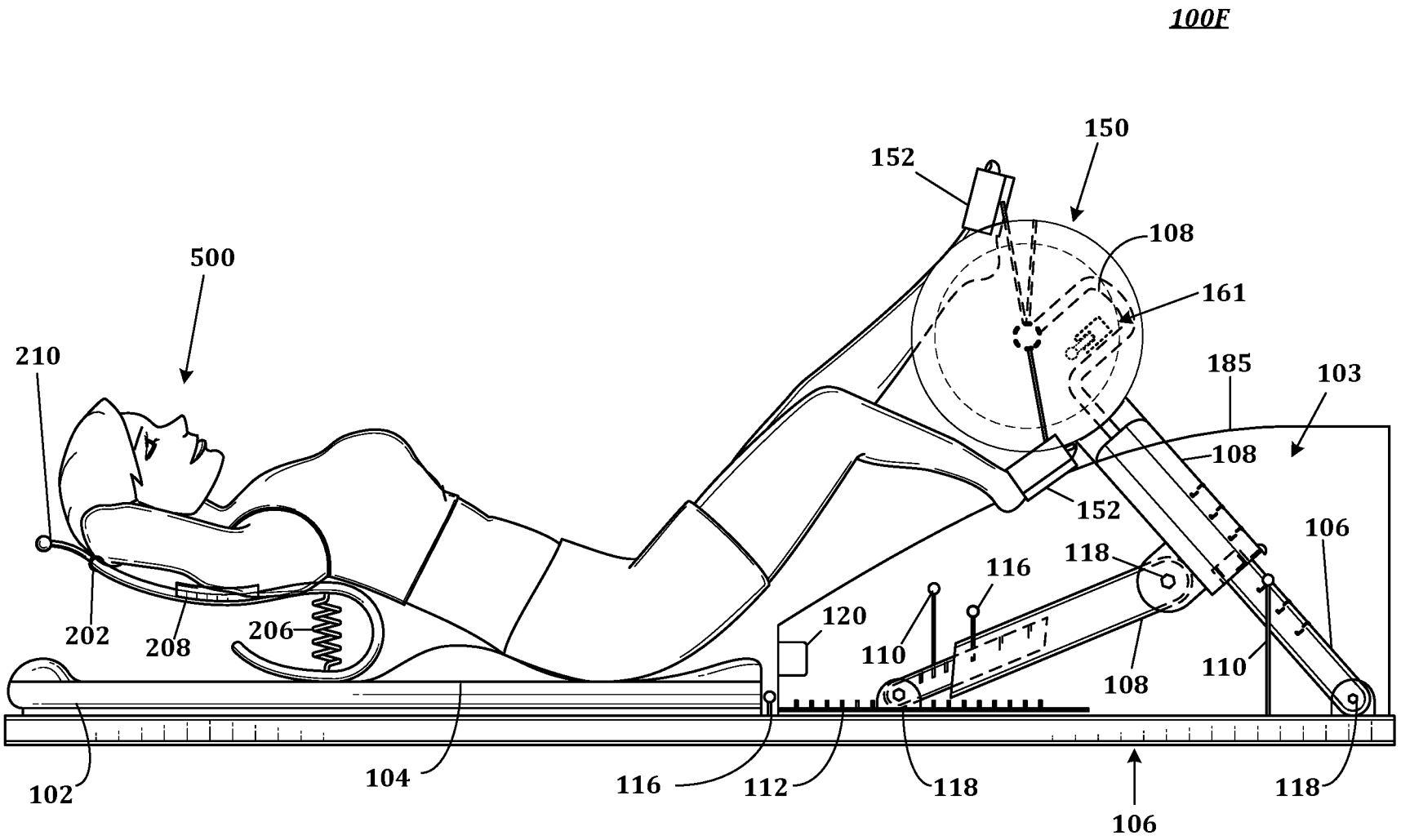

For example, example implementation 100F may include an abdominal exercise cycling apparatus 100A as described completely in FIG. 1A-1E with the exception of FIG. 1F, 100F showing a person 500 using the abdominal exercise cycling apparatus in an acute fixed position with the shoulder backwards press assembly 200. As shown in FIG. 1F, and by reference numbers 200, 202, 206, 208, and 210, a person 500 may increase intensity of the exercise by interlocking fingers behind the head while pedaling with elbows in an outward position in an elevated supine position where the upper torso may be elevated on a shoulder backwards press 200. The shoulder backwards press may have a support member 202, arm rest 208, spring assembly 206, and head rest 210. In at least one implementation, the shoulder backward press assembly 200 may be included. The shoulder backward press assembly 200 may allow a person 500 to use negative resistance by pressing in a backwards direction to exercise abdominal muscles. The user 500 may select to elevate their torso off of the shoulder backward press assembly 200 if they choose and or not able to raise and hold their shoulders off the surface above the shoulder backward press apparatus 200.

As indicated above, FIGS. 1A-1F are provided merely as examples. Other examples are possible and may differ from what is described with regard to FIGS. 1A-1F.

Figure 2A:
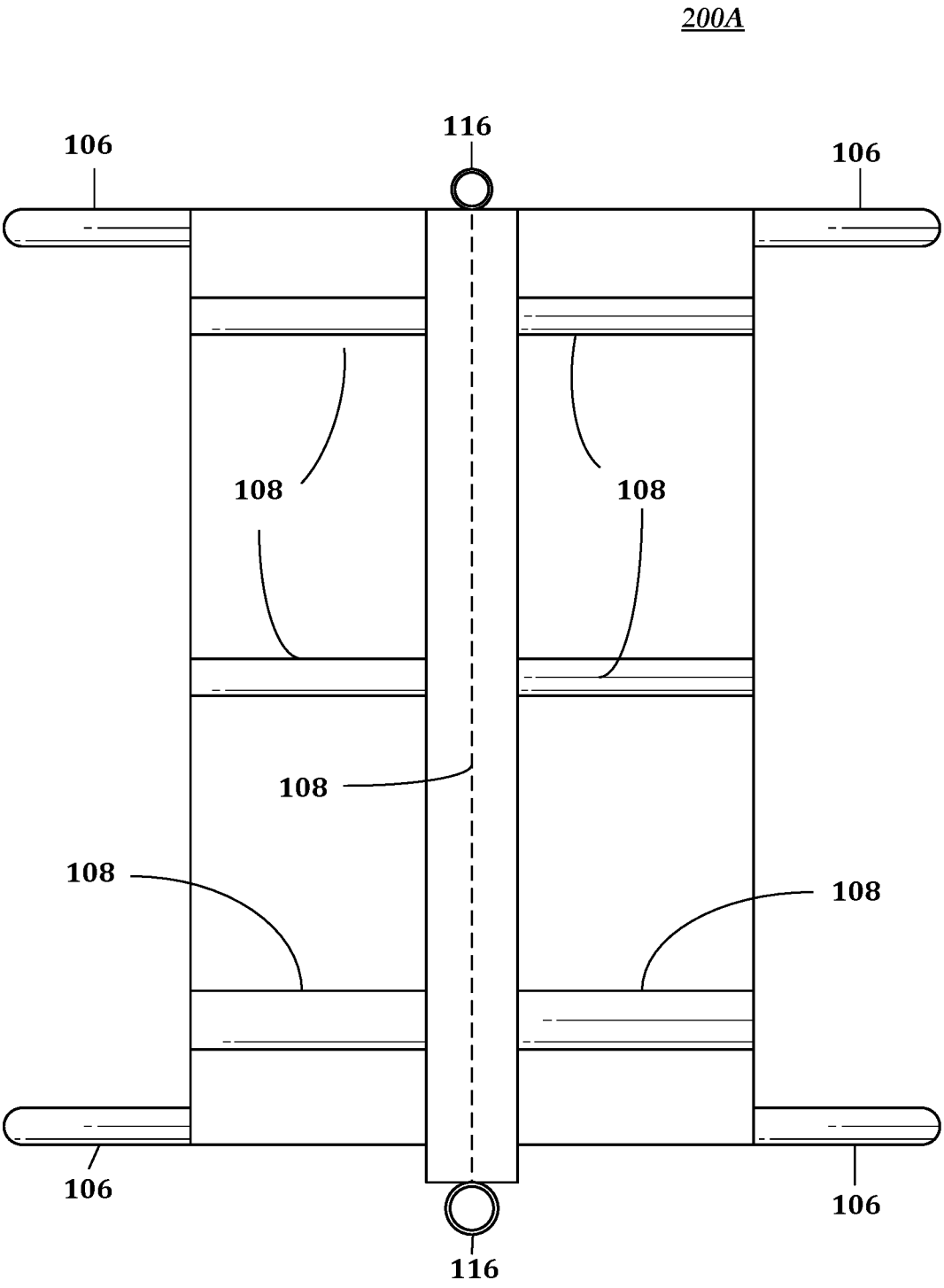
FIGS. 2A-2F are diagrams of example components of one or more components of the abdominal exercise cycling apparatus shown in FIG. 1A-FIG. 1F.
Figure 2B:
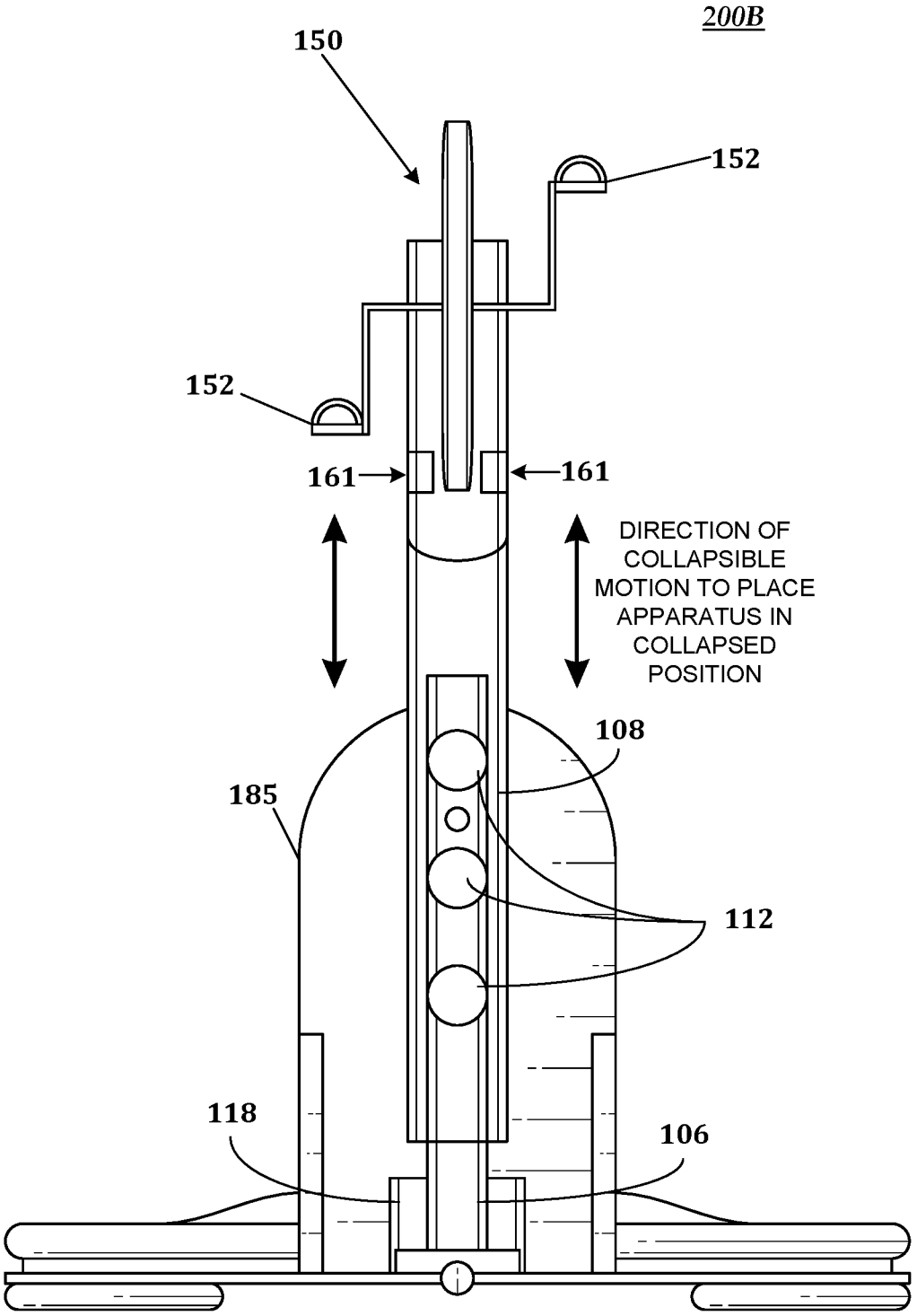
Figure 2C:
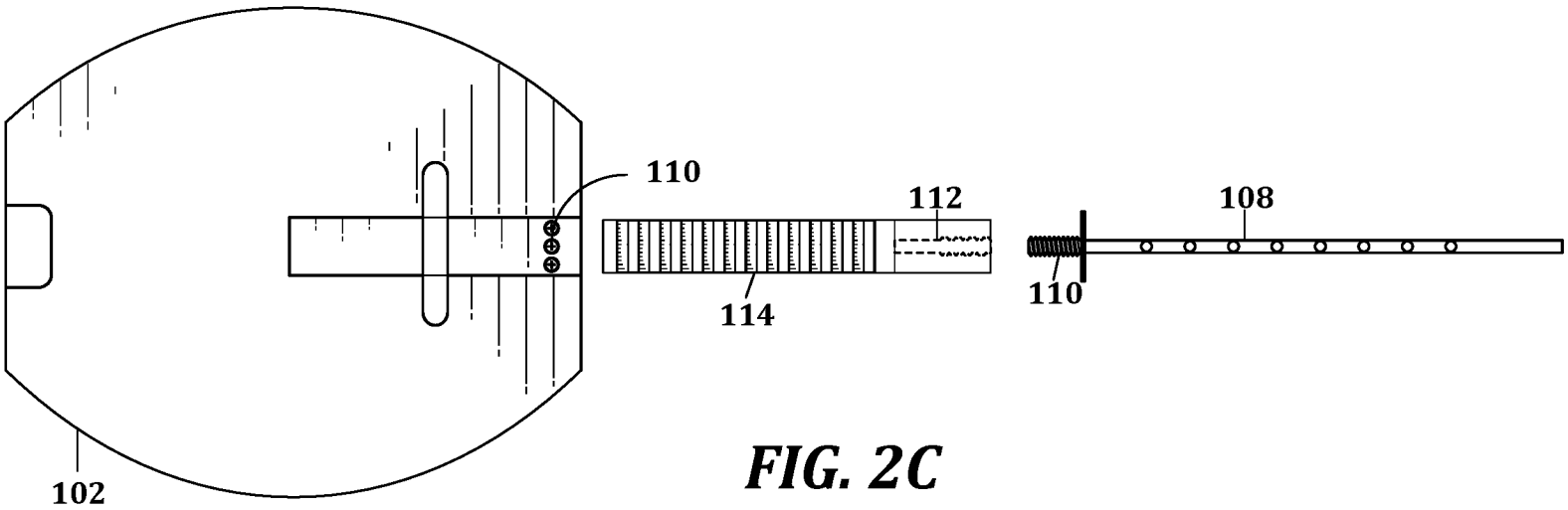
Figure 2D:
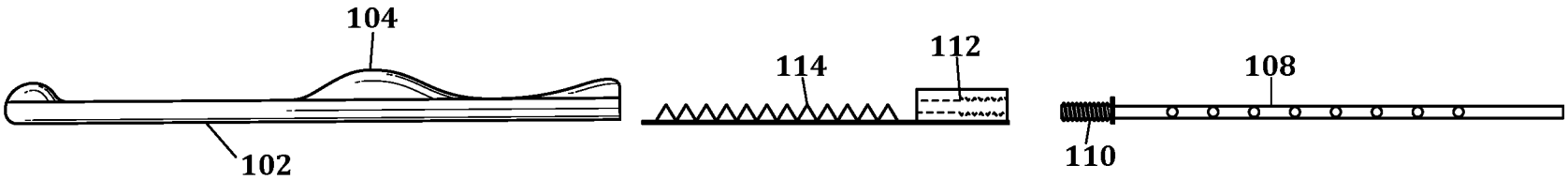
Figure 2E:
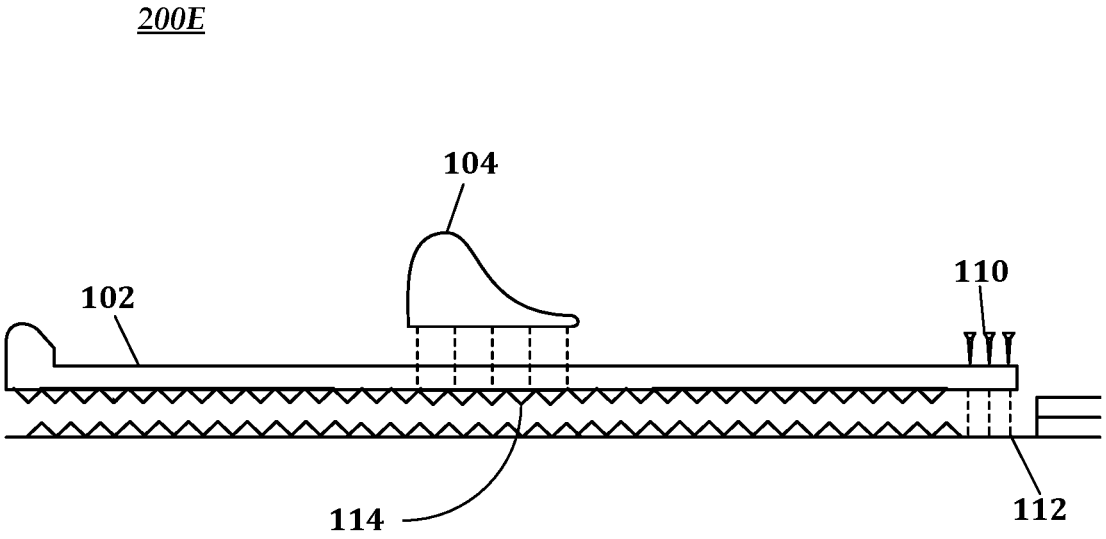
Figure 2F:
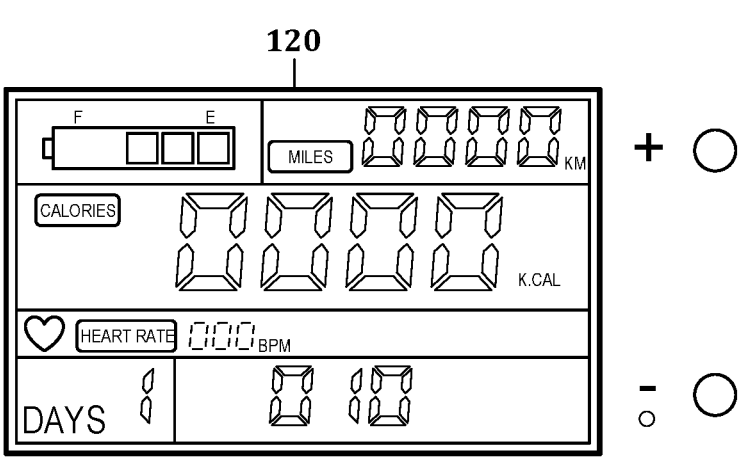

FIGS. 2A-2F are diagrams of example components 200A-200F of one or more components of the abdominal exercise cycling apparatus shown in FIG. 1A-FIG. 1F. For example, example implementation 200A may include an overhead view of an abdominal exercise cycling apparatus 200A. As shown in FIG. 2A, and by reference number an anterior portion of an abdominal exercise cycling apparatus 200A may include an overhead view of horizontal frame members 106, vertical frame members 106, horizontal stabilizing members 108 and adjustment members 116.

In an embodiment, example implementation 200B may include a front view from the posterior of an abdominal exercise cycling apparatus 100A in the upright position. As shown in FIG. 2B, and by reference number 112, the apertures for the various fasteners 110 are visible. Frame members 106, rotating pin connection 118, housing 185, stabilizing member 108 are visible. In at least one implementation, cycling resistance apparatus 150 contactless eddy brake assembly 161, and pedaling unit 152 may be visible. Dual arrows show the directions of movement for the abdominal exercise cycling apparatus when moving to an acute position or a collapsed position.

In an embodiment, example implementation 200C may include a top view of the body support apparatus and the anti-slip component 114. In at least one implementation, the body support apparatus may include a body pad 102 which may be secured to a base apparatus comprising one or more frame members 106, which may be secured using a plurality of fasteners 100. The base apparatus may have the anti-slip component 114. The anti-slip component 114 may have a friction textured upper surface configured to interlock with the lower surface of the body support apparatus, the base apparatus may include a stabilizing member 108. The stabilizing member may provide a rigid connection between the anti-slip component 114 and a frame member 106. In at least one implementation, a stabilizing member 108 which may have one or more apertures 112, the one or more apertures 112 positioned to accept one or more adjustment members 116, and at least one fastener 110, the fastener rigidly secured to an aperture 112 of the anti-slip component 114. The frame apparatus may include an adjustment member 116 that can be capable of holding the frame member 106 in at least one fixed position.

In an embodiment, example implementation 200D may include a side view of the body support apparatus and the anti-slip component 114. In at least one implementation, the body support apparatus may include a body pad 102 which may be secured to a base apparatus comprising one or more frame members 106, which may be secured using a plurality of fasteners 100. The base apparatus may have the anti-slip component 114. The anti-slip component 114 may have a friction textured upper surface configured to interlock with the lower surface of the body support apparatus, the base apparatus may include a stabilizing member 108. The stabilizing member may provide a rigid connection between the anti-slip component 114 and a frame member 106. In at least one implementation, a stabilizing member 108 which may have one or more apertures 112, the one or more apertures 112 positioned to accept one or more adjustment members 116, and at least one fastener 110, the fastener rigidly secured to an aperture 112 of the anti-slip component 114. The frame apparatus may include an adjustment member 116 that can be capable of holding the frame member 106 in at least one fixed position.

In an embodiment, example implementation 200E may include a side view of another implementation of the body support apparatus and the anti-slip component 114. In at least one implementation, the body support apparatus may include a body pad 102 which may be secured to a base apparatus comprising one or more frame members 106, which may be secured using a plurality of fasteners 100. The base apparatus may have the anti-slip component 114. The anti-slip component 114 may have a friction textured upper surface configured to interlock with the lower surface of the body support apparatus, the base apparatus may include a stabilizing member 108. The stabilizing member may provide a rigid connection between the anti-slip component 114 and a frame member 106. In at least one implementation, a stabilizing member 108 which may have one or more apertures 112, the one or more apertures 112 positioned to accept one or more adjustment members 116, and at least one fastener 110, the fastener rigidly secured to an aperture 112 of the anti-slip component 114. The frame apparatus may include an adjustment member 116 that can be capable of holding the frame member 106 in at least one fixed position. In at least one implementation, the anti-slip component 114 may include an elongated member of varying lengths, the varying lengths including but not limited to: the length from one end of the anti-slip component 114 to the center of the body pad 102, the length from one end of the anti-slip component 114 to the adjustable lumbar support pad 104, or the length from one end of the anti-slip component 114 to a portion of the body pad 102.

In an embodiment, example implementation 200F may include an implementation of a display 120. As indicated above, FIGS. 2A-2F are provided merely as examples. Other examples are possible and may differ from what is described with regard to FIGS. 2A-2F.

Figure 3A:
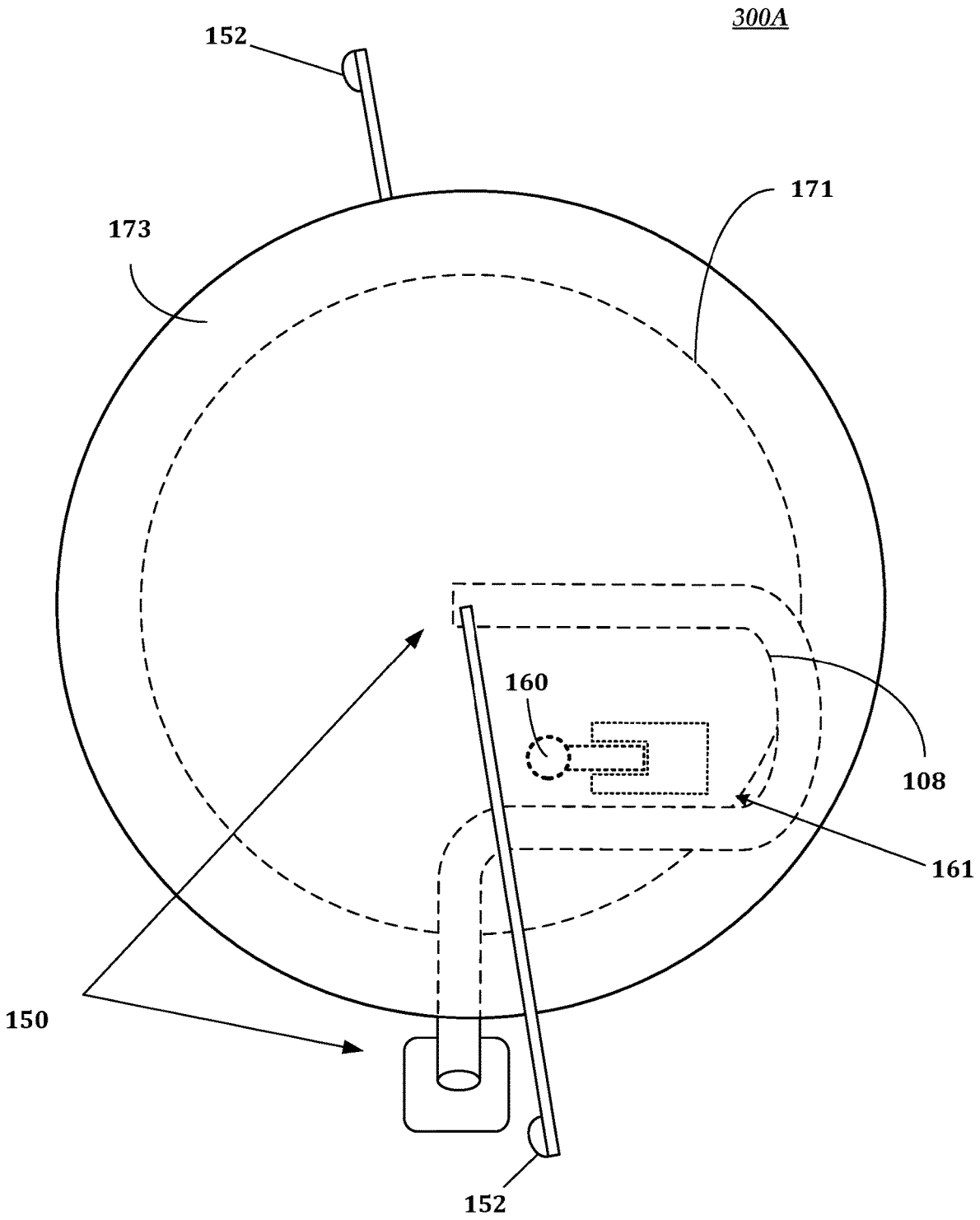
FIG. 3A-3B are diagrams of example components of one or more components of the abdominal exercise cycling apparatus shown in FIG. 1A-FIG. 1F.
Figure 3B:
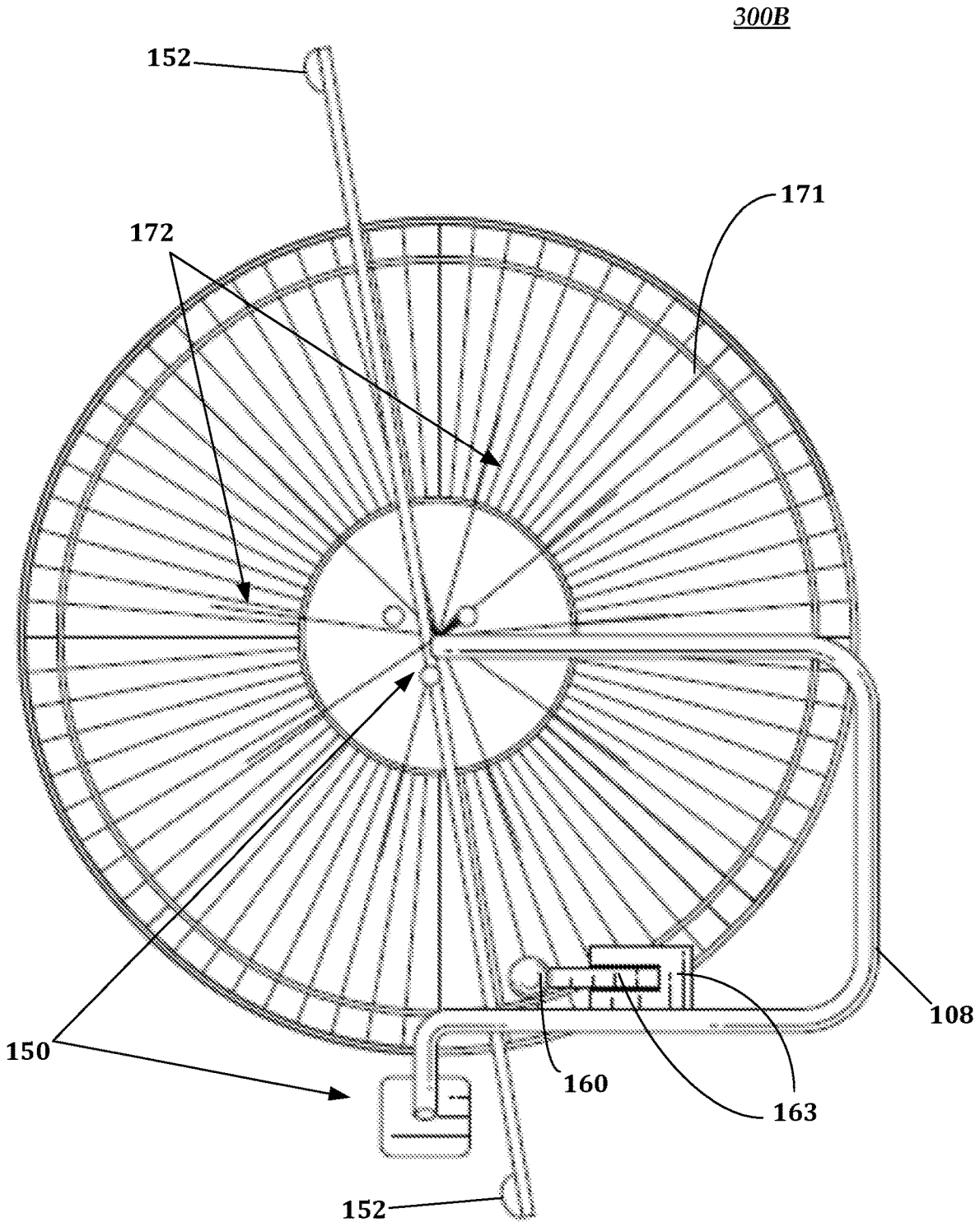

FIG. 3A-3B are diagrams of example components 300A-300B of one or more components of the abdominal exercise cycling apparatus shown in FIG. 1A-FIG. 1F.

In an embodiment, example implementation 300A may include a cycling resistance apparatus 150, a pedaling unit 152, a cooling shroud 170, a wheel disk cover 173, a contactless eddy braking assembly 161, and a stabilizing member 108. The wheel disk cover 173 may secure eddy braking assembly 161 from the public safeguarding from injury from contacting the eddy braking system and cycling resistance apparatus 150 components. In at least one implementation, the wheel disk cover 173 may include areas for color, images, branding, labeling, adding content to the surface of the wheel disk 173.

In an embodiment, example implementation 300B may include an uncovered wheel disk 171 which may include a disk fan blade 172 (FIG shows a plurality of disk fan blades 172) where the fan blades may provide wind for cooling the user 500 during a cycling motion. a cycling resistance apparatus 150, a pedaling unit 152, a cooling shroud 170, a contactless eddy braking assembly 161, and a stabilizing member 108. In at least one implementation, the disk fan blade 172 may be connected to a fastener 110 or belt which may provide a mechanism for providing a fan system for cooling a user 500 during operation. As shown in FIG. 3B, the eddy braking assembly 161 show a magnet 160 and dual cylinders 163.

As indicated above, FIGS. 3A-3B are provided merely as examples. Other embodiments are possible and may differ from what is described with regard to FIGS. 3A-3B.

Figure 4A:
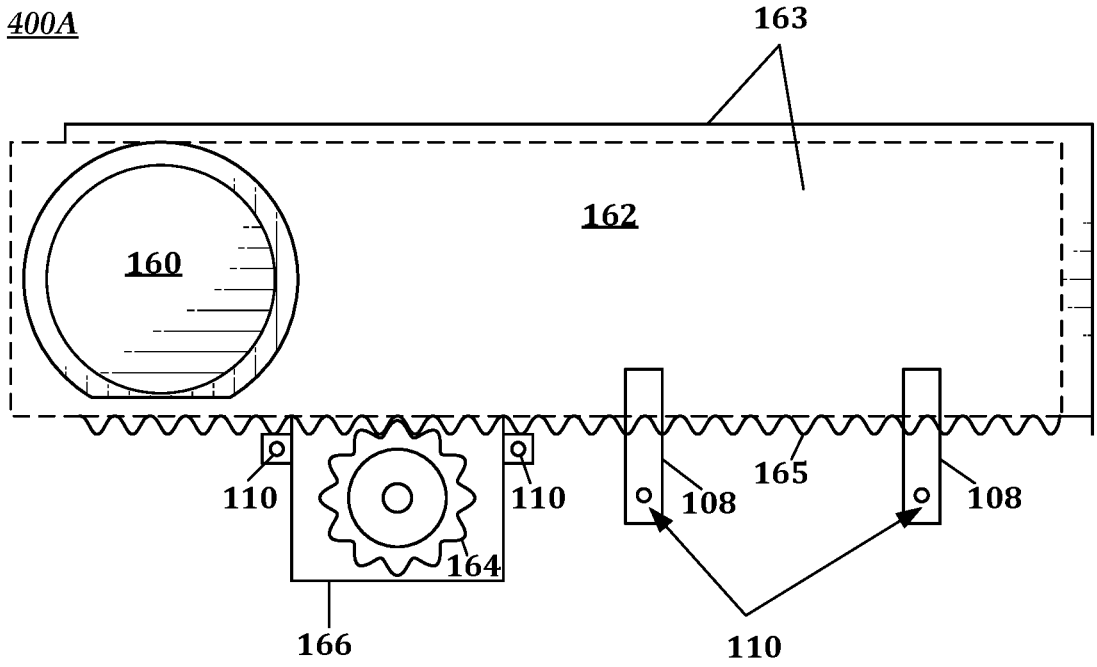
FIG. 4A-4C are diagrams of example components of one or more components of the abdominal exercise cycling apparatus shown in FIG. 1A-FIG. 1F.
Figure 4B:
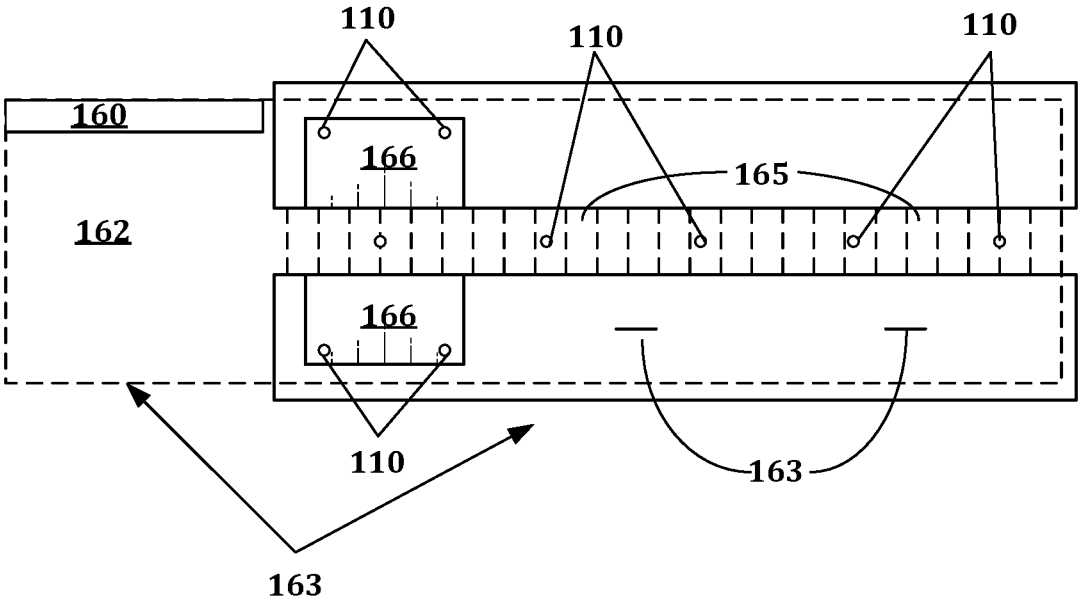
Figure 4C:
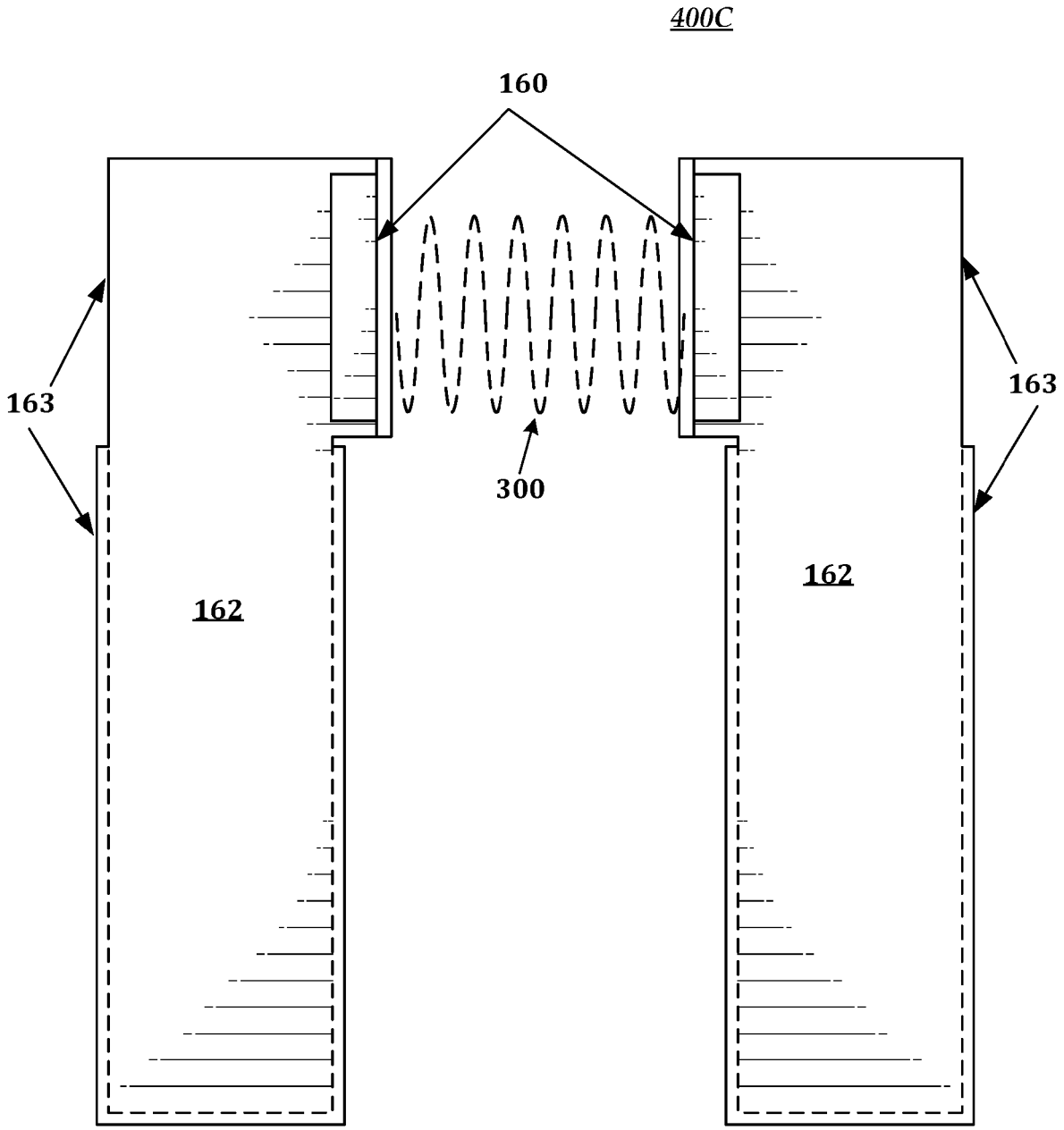

FIG. 4A-4C are diagrams of example components 400A-400C of one or more components of the abdominal exercise cycling apparatus shown in FIG. 1A-FIG. 1F. For example, as shown in FIGS. 4A-4C, example implementation 400A-400C may include cycling resistance apparatus 150 of the abdominal exercise cycling apparatus 100. The cycling resistance apparatus 150 may have a contactless eddy brake assembly 161. The contactless eddy brake assembly 161 may have a magnet assembly. The magnet assembly can include a pair of opposing magnets 160. The pair of opposing magnets may reside within two-cylinder components (FIGS. 4A-4C show an individual cylinder 162). The two-cylinder component 162 are shown in FIG. 2B as part of the contactless eddy braking assembly 161. FIG. 4A and FIG. 4C shows the individual cylinder component 162, each housing a magnet 160. The two-cylinder components 162 may be positioned on opposing sides of a motor 164. The motor 164 may include a motor box 166 which may be positioned to contact a gear track 165 The motor 164, motor box 166, and gear track 165 may collectively form a gear assembly 165. The gear assembly may be positioned between the magnetic field of the pair of opposing magnets 160 of the magnet assembly. The magnet assembly and gear assembly may be positioned about a pedal assembly 152. Herein, a pedal assembly 152 may also be referred to as a pedaling unit 152 and as a pedaling system 152. The pedal assembly 152 may include a crank arm. The crank arm may include a foot rest. The crank arm and foot rest may rotate about a focus or center of a rotational axis. The crank arm and foot rest may propel a wheel disk in a cyclical motion. The cycling resistance apparatus 150 may utilize the contactless eddy brake assembly 161 in a manner that creates progressively increasing resistance as speed increases.

FIG. 4A shows a side view of a contactless Eddy brake assembly 161. FIG. 4B shows a bottom view of a contactless Eddy brake assembly 161. FIG. 4C shows a top view of a contactless Eddy brake assembly 161.

Regarding the contactless eddy brake assembly 161, it may include a resistance device that may use eddy currents in conjunction with one or more a pivoting or opposing magnets that may be positioned internally in a manner that creates progressively increasing resistance as speed increases.

In at least one implementation, the contactless eddy brake assembly 161 may include an automatically adjusting magnetic resistance unit for an exercise apparatus which may further be configured in a manner which provides for the degree of resistance to automatically and non-linearly be adjusted in relation to the rotational speed of a rotating member caused by the input of a user powering for example a pedaling unit 152. In at least one implementation, the contactless eddy brake assembly 161 may include a rotating member which may be in the form of a flywheel having one or more supports extending between a hub and a rim. The one or more supports may define longitudinal grooves which may slidably retain magnets 160 that are biased inwardly toward the hub by biasing members. In at least one implementation, the contactless eddy brake assembly 161 may include an electrically conductive member located adjacent to the aforementioned flywheel. The flywheel may rotate in response to rotation of the wheel disk which may cause the magnets interact with the conductive member to establish eddy currents that provide resistance to the rotation of the flywheel. In at least one implementation, the contactless eddy brake assembly 161 may be adapted such that the speed of rotation of the aforementioned flywheel may increase as the speed of rotation of the wheel disk increases. In at least one implementation, the centrifugal forces may act on the magnets 160 which may cause the magnets 160 to slide outwardly along the grooves in opposition to the bias of the biasing members. The outward movement of the magnets 160 may cause outward movement of the eddy current forces, to increase the resistance provided in relation to the aforementioned rotation of the flywheel and the wheel disk. In at least one implementation, the variable resistance due to the increased or decreased rotational speed of the flywheel is smooth, based on the constant interaction of the counter-acting forces of the biasing members and the centrifugal forces acting on the magnets 160. Resistance may be adjusted by a user selection from the display 120 where a user may increase or decrease resistance.

The contactless eddy braking assembly 161 may provide resistance for the abdominal exercise cycling apparatus 100 for developing or strengthening the muscles or joints of the body by working against a counterforce, with or without measuring devices using electromagnetic or electric force-resisters using eddy currents induced in moved elements, e.g. by permanent magnets induced by electromagnets. The contactless eddy braking assembly 161 may provide a mechanism for resistance. The contactless eddy braking assembly 161 may provide different levels of intensity depending on user inputs for increased or decrease. For the abdominal exercise cycling apparatus 100, there is no drive train in the unit. The contactless eddy braking assembly 161 may function in a powered state via a battery or power supply. In at least one implementation, the contactless eddy braking system 161 may operate without a power supply.

In at least one implementation, the contactless eddy braking system 161 may be assembled by adding one or more actuating magnets 160 to a dual cylinder slide out system shown as dual cylinders 163. Dual cylinders 163 may refer to one half of the eddy braking assembly 161 whereby the dual aspect is an inner and outer cylinder combination as shown in FIG. 3B, 163 and FIGS. 4A-4C, 163. The dual cylinders 163 may be positioned on both sides of the wheel disk 171 as shown in FIG. 2B.

In at least one implementation, as shown in FIG. 4C, there may be a pair of dual cylinders 163 and a pair of actuating magnets 160 which may be moved by a motorized gear box 166, powered by a motor 164, moving along a gear track 165, attached underneath the dual cylinders 163, as shown in FIGS. 4A-4B. In at least one implementation, as shown in FIG. 4C, the pair of dual cylinders 163 and pair of actuating magnets 160 may be positioned in parallel with the actuating magnets 160 facing each other. The contactless eddy braking system 161 may generate resistance based on the eddy currents of the opposing electromagnetic forces 300. In at least one implementation, the wheel disk 171 may be positioned between the eddy currents of the opposing electromagnetic forces 300. In at least one implementation, the eddy currents of the opposing electromagnetic forces 300 may provide varying levels of resistance to the spinning or rotating movement of the wheel disk 171.

In at least one implementation, a display 120 is directly connected to the contactless eddy braking system 161 via at least one of a wired connection, and a wireless connection. In at least one implementation, the contactless eddy braking system 161 may include at least one of a small 12 v battery, a power supply, a power cord, one or more batteries, and an external power source which may be attached to power the apparatus. As shown in FIG. 4A, the dual cylinders may be attached via fasteners 110 and stabilizing members 108 to a wheel disk 171 (not shown in FIG. 4A).

In an alternative implementation, there may be a for developing or strengthening the muscles or joints of the body by working against a counterforce, without using electromagnetic or electric force-resisters using eddy currents induced in moved elements, instead using physical counterweights within a cycling resistance apparatus 150.

As indicated above, FIGS. 4A-4C are provided merely as examples. Other examples are possible and may differ from what is described with regard to FIGS. 4A-4C.

Figure 5A:
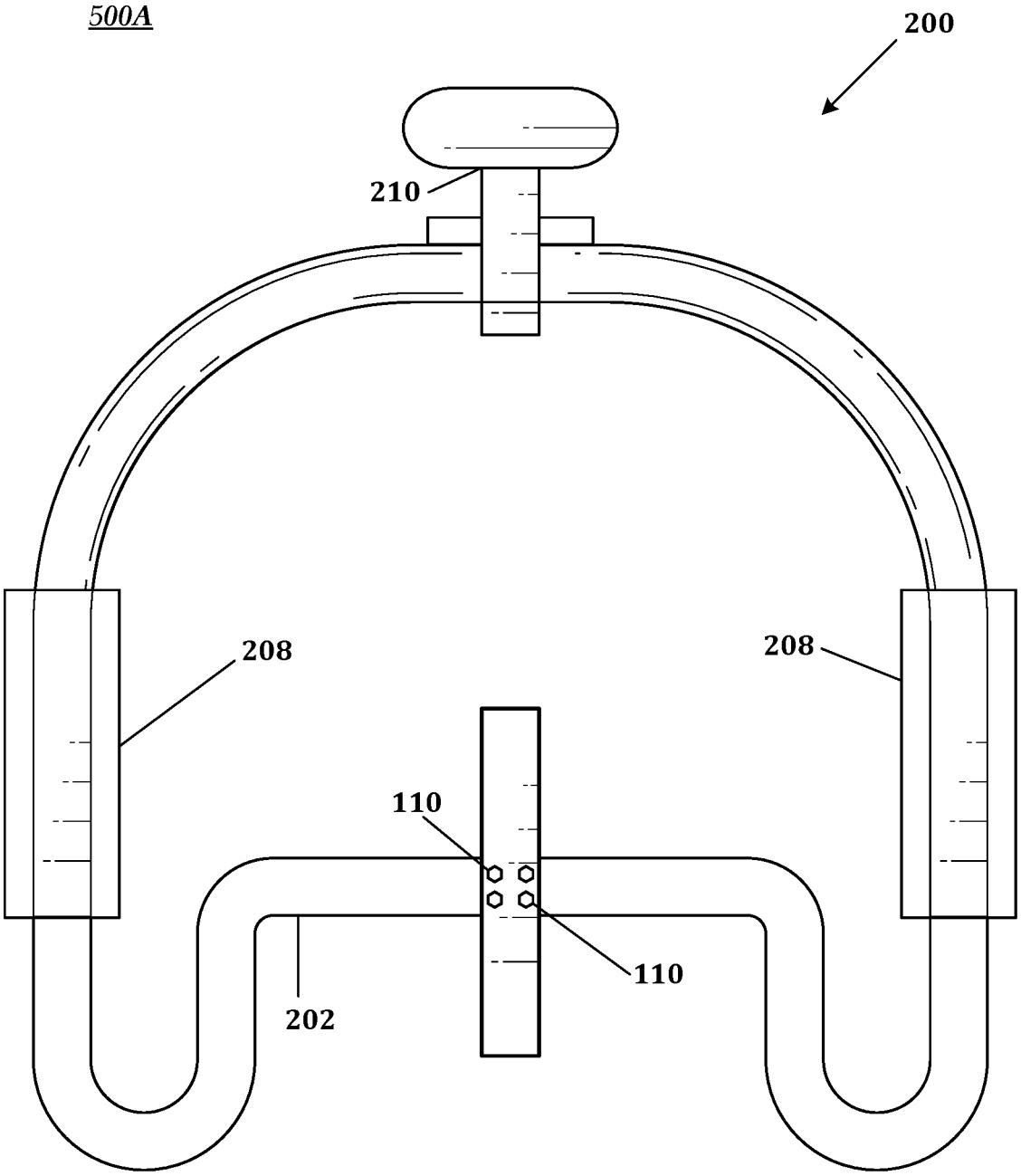
FIG. 5A-5B are diagrams of example components of one or more components of the abdominal exercise cycling apparatus shown in FIG. 1A-FIG. 1F.
Figure 5B:
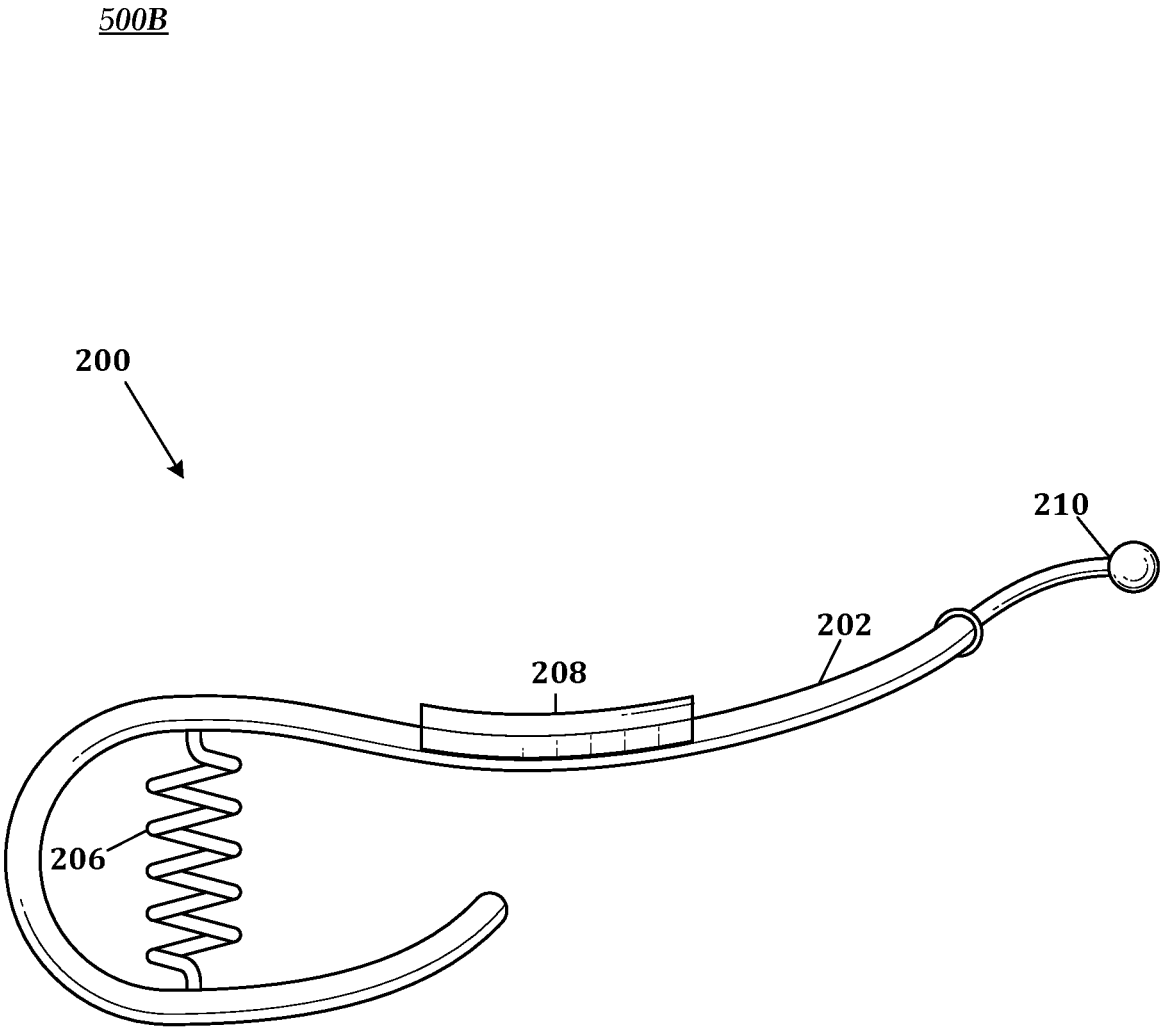

FIG. 5A-5B are diagrams of example components 500A-500B of one or more components of the abdominal exercise cycling apparatus 100 shown in FIG. 1A-FIG. 1F.

For example, example implementation 500A may include a top view of a shoulder backward press assembly 200. Example implementation 500B may include a side view of a shoulder backward press assembly 200. As shown in FIGS. 5A, 500A and 5B, 500B, a shoulder backwards press 200, comprising a support member 202, arm rest 208, spring assembly 206, and head rest 210. All of these elements may be joined using one or more fasteners 110. In at least one implementation, the shoulder backward press assembly 200 may be included. The shoulder backward press assembly 200 may allow a person 500 to use negative resistance by pressing in a backwards direction to exercise abdominal muscles. The user 500 may select to elevate their torso off of the shoulder backward press assembly 200 if they choose and or not able to raise and hold their shoulders off the surface above the shoulder backward press apparatus 200.

As indicated above, FIGS. 5A-5B are provided merely as examples. Other examples are possible and may differ from what is described with regard to FIGS. 5A-5B.

In at least one implementation, the abdominal exercise cycling apparatus 100 may be used as shown in FIG. 1A-FIG. 1F. In one or more implementations, the speed of the revolutions improves cardio vascular impact of the abdominal exercise cycling apparatus 100. The user 500 may lie in a supine position on their back while straddling the abdominal exercise cycling apparatus 100 between their legs. A user's 500 feet should be placed into the pedal assembly 152. For optimal results, a user 500 may curl back off the body pad 102 by elevating shoulders off of the pad at varied heights during the pedaling motion. Initially, a user 500 may start pedaling at a comfortable rate of limited exertion with initial light resistance. Subsequently, a user 500 may perform multiple sets of numerous revolutions (e.g., 30 to 40 revolutions) of the pedals for one set and then rest. As a user 500 gains endurance using the abdominal exercise cycling apparatus 100, more revolutions may be added per set of exercise reps.

In at least one implementation, a user 500 of the abdominal exercise cycling apparatus 100 may engage with a display 120. In at least one implementation, the display 120 may include but not be limited to: a digital readout for: Speed/revolutions per minute (RPM), Workout Time, Distance Traveled, Calories Burned, Heart Rate/beats per minute (BPM) and the other data.

In at least one implementation, an additional cushion or pad 180 may be fastened to the vertically positioned stabilizing member 108 and vertically positioned frame member at the posterior end of the abdominal exercise cycling apparatus 100A. In at least one implementation, the additional cushion or pad 180 may be connected a removably insertable body pad 102. In at least one implementation, the additional cushion 180 and body pad 102 may together form a seat. In at least one implementation, the abdominal exercise cycling apparatus 100 may include a seat. In at least one implementation, the seat may be elevated to a position that may provide for cycling the abdominal exercise cycling apparatus 100 like at least one of a stationary bike, an elliptical machine, and a recumbent bike.

In at least one implementation, the seat may be positioned at the posterior of the abdominal exercise cycling apparatus 100 such that the back of a user 500 rests against the vertically positioned stabilizing member 108 and vertically positioned frame member at the posterior end of the abdominal exercise cycling apparatus 100A. In at least one implementation, a user 500 may utilize hands and upper limbs to engage the pedal assembly 152. This may provide a level of cardiovascular benefit for users unable to performed more advance movement.

In at least one implementation, the abdominal exercise cycling apparatus 100 may include one or more extended members attached to the pedal assembly 152 for an alternative exercise motion. In at least one implementation, the abdominal exercise cycling apparatus 100 may include at least one of a handle or a grip attached to the pedal assembly for alternative upper limb exercise motion. In at least one implementation, the abdominal exercise cycling apparatus 100 exercises may be performed with or without the additional cushion 180, seat and other components. The position of a user's 500 body may be modified in any creative number of movements or positions as long as the positions support safe and effective use of the abdominal exercise cycling apparatus 100.

In at least one implementation, the abdominal exercise cycling apparatus 100 may include seat that allows the unit to be used as a traditional sit-down exercise bike. In at least one implementation, the abdominal exercise cycling apparatus 100 may include an additional cushion or pad 180 which may allow for the rotation of the pedals in a cyclical direction by a user's 500 arms. This may provide for cardiovascular exercise by connecting the optional seat to the front of the abdominal exercise cycling apparatus 100. In at least one implementation, the abdominal exercise cycling apparatus 100 may include a wheel pedaling resistance system increase and decrease automatically as a person 500 cycles utilizing positive and negative resistance training.

In at least one implementation, the abdominal exercise cycling apparatus 100 may include a specialized additional seat when incorporated with the abdominal exercise cycling apparatus 100, may be used as a traditional exercise stationary bike. Such use may be desired for users who are obese, lack cardio endurance, have limited motion and may not able to use traditional equipment. In at least one implementation, the abdominal exercise cycling apparatus 100 may include a user configurable seat with one or more positions such that a first position may provide for cycling our system as a stationary bike; a second position may provide for cycling in a supine position; a third position may provide for the seat positioned in such a manner that may provide for rotating the pedals with the arms for a cardio workout. In at least one implementation, the abdominal exercise cycling apparatus 100 may include additional user positioning for more optimal workouts including performing alternative exercises while sitting with the legs extended out in front of the abdominal exercise cycling apparatus 100. In this position, a user 500 may perform yoga and stretches of the hamstring and calf muscles which also helps develop core strength. Exercises may be performed at with the abdominal exercise cycling apparatus 100. In at least one implementation, the abdominal exercise cycling apparatus 100 may include a body pad 102 such that a user 500 may perform yoga and stretches of the hamstring and calf muscles which also helps develop core strength.

Figure 6A:
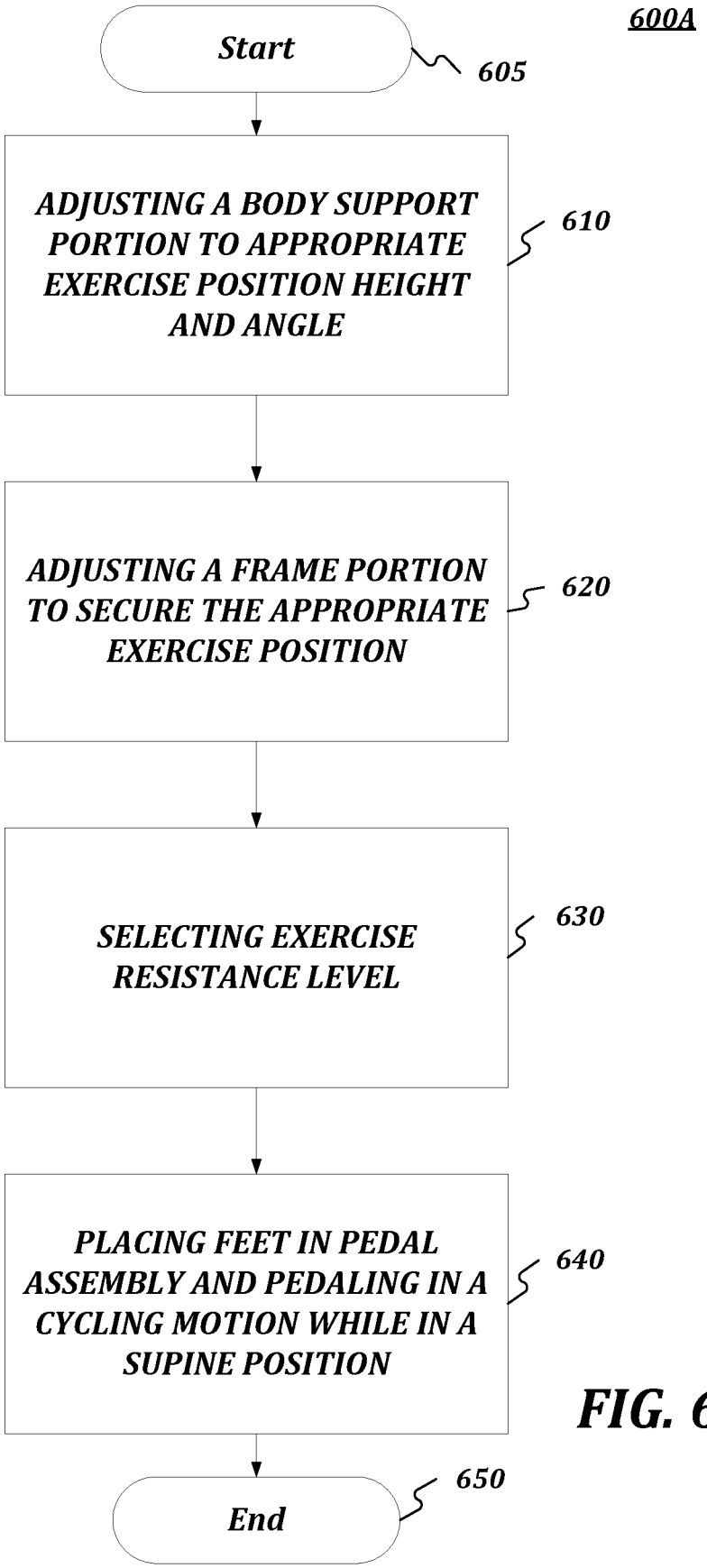
FIGS. 6A-6B are flow charts an example process for providing the abdominal exercise cycling apparatus, in accordance with an embodiment of the present disclosure.
Figure 6B:
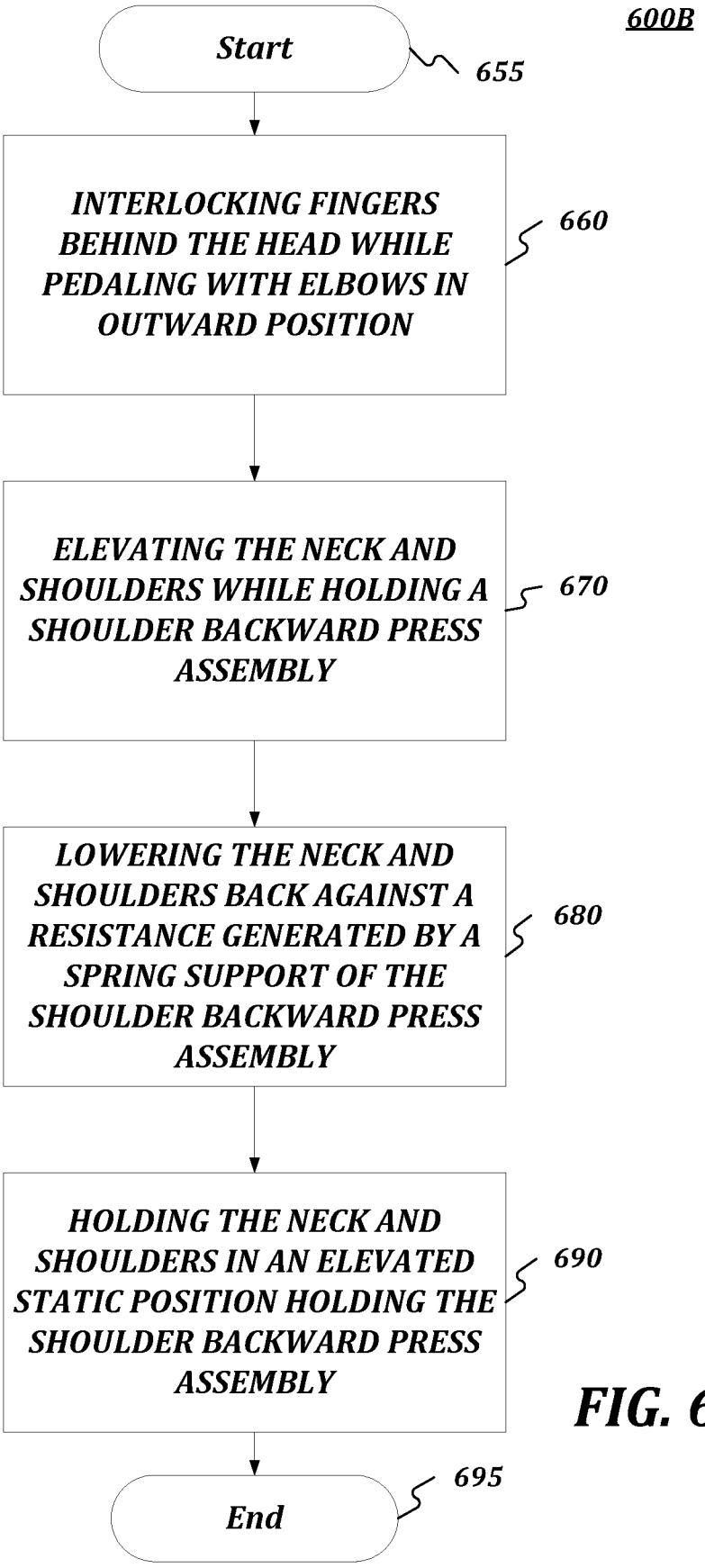

FIGS. 6A-6B are flow charts an example process for providing the abdominal exercise cycling apparatus, in accordance with an embodiment of the present disclosure.

FIGS. 6A and 6B are flow charts setting forth the general stages involved in a methods 600A and 600B consistent with an embodiment of the disclosure for providing the abdominal exercise cycling apparatus disclosed herein. Methods 600A and 600B may be implemented using the abdominal exercise cycling apparatus as described in more detail below with respect to FIGS. 6A and 6B.

Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein.

FIG. 6A is a flow chart of an example process 600A and FIG. 6B is a flow chart of an example process 600B. In at least one implementation, a process may include:

adjusting a body support portion, of an exercise apparatus, to an appropriate exercise position having height and angle;

adjusting a frame portion, of an exercise apparatus, to the appropriate exercise position including securing a stabilizing member to hold the appropriate exercise position;

selecting, using a user interface of a display, one or more settings including at least time period of exercise and level of exercise resistance;

placing feet in a foot stirrup of a pedal assembly while placing torso in a supine position on the body support portion; and pedaling the pedal assembly with force in a cycling motion against a resistance generated by a contactless eddy braking assembly.

In some implementations, the process may include:

holding the neck and shoulders in a static position on the upper surface of the body support portion while pedaling continuously;

interlocking fingers behind the head while pedaling with elbows in an outward position;

elevating the neck and shoulders off of the body support portion while pedaling continuously;

lowering the neck and shoulders back to an upper surface of the body support portion;

performing a sit-up motion at varied intervals while pedaling continuously.

In some implementations, the process may include:

holding the neck and shoulders in a static position elevated above the upper surface of the body support portion;

holding the neck and shoulders in a static position elevated above the upper surface of the body support portion at an angle between ten and ninety degrees.

In some implementations, the process may include:

interlocking fingers behind the head while pedaling with elbows in an outward position;

elevating the neck and shoulders holding a shoulder backward press assembly while pedaling continuously;

lowering the neck and shoulders back against a resistance generated by a spring support of the shoulder backward press assembly.

In some implementations, the process may include:

holding the neck and shoulders in an elevated static position holding a shoulder backward press assembly while pedaling continuously.

In some implementations, the process may include:

holding the neck and shoulders in an elevated static position holding a shoulder backward press assembly at an angle between ten and ninety degrees.

In some implementations, the process may include:

adjusting the angle of the cycling resistance apparatus 150 from 0° to 45° for the desired exercise intensity;

syncing abdominal exercise cycling apparatus 100 to a display 120;

adjusting the intensity level of the pedaling system 152 by engaging a user interface on the display 120 (e.g. pushing the button"+" for increasing the intensity or the button "–" for reducing the intensity. The user interface may be located proximal to the display 120);

adjusting the length of the exercise pad by lifting an adjustment member 116 of abdominal exercise cycling apparatus 100 (e.g. sliding a stabilizing member 108 to the appropriate length and then release the adjustment member 116);

positioning the adjustable lumber support pad 104 to an appropriate position and securing a fastener 110 to a frame member 106;

positioning body in a supine position on body pad 102 with feet in stirrup on the foot pedal via a pedaling unit 152;

elevating head and neck above a headrest of body pad 102 while interlocking fingers behind neck with no lifting pressure;

elevating shoulder blades to an elevated position above the body pad 102 (e.g., 4 to 6 inches above the body pad 102 plane, elevating to a higher position for more intense results);

curling body in a backwards motion accomplished by contracting abdominal muscles;

holding a static position during repeated exercise movements;

breathing adequate breathes while engaging the pedaling system 152;

gradually increasing intensity of movements (User may desire to start at a lower intensity and higher repetition cycles (e.g. from 30 to 40 revolutions or 2 to 3 minutes between rest periods);

based on the intensity level in the preceding step, determining the level of muscle engagement for toning of the abdominals and legs muscles.

Ways to implement the stages of method 600A will be described in greater detail below. Method 600A may begin at starting block 605 and proceed to stage 610 where the abdominal exercise cycling apparatus 100 may be manipulated to adjust a body support portion to an appropriate exercise position height and angle. For example, moving the abdominal exercise cycling apparatus 100 from an upright position to an acute operating position 100B. In another instance, the abdominal exercise cycling apparatus 100 may be positioned to a collapsed operating position 100C. In yet further instances, the abdominal exercise cycling apparatus 100 may be placed in another stationary position for an effective operating mode such as a desired exercise position.

From stage 610, where the abdominal exercise cycling apparatus 100 may be manipulated to adjust a body support portion to an appropriate exercise position height and angle, method 600 may advance to stage 620 where the abdominal exercise cycling apparatus 100 may be manipulated to adjust a frame portion to secure the appropriate exercise position. For example, moving the abdominal exercise cycling apparatus 100 from an upright position to an acute operating position 100B. In another instance, the abdominal exercise cycling apparatus 100 may be positioned to a collapsed operating position 100C. In yet further instances, the abdominal exercise cycling apparatus 100 may be placed in another stationary position for an effective operating mode such as a desired exercise position.

Once the abdominal exercise cycling apparatus 100 may be manipulated to adjust a frame portion to secure the appropriate exercise position in stage 620, method 600 may continue to stage 630 where a user of the abdominal exercise cycling apparatus 100 may select an effective exercise resistance level using a user interface via a display 120. For example, selecting a starting exercise resistance level using a user interface via a display 120 of the abdominal exercise cycling apparatus 100.

After a user of the abdominal exercise cycling apparatus 100 may select an effective exercise resistance level using a user interface via a display 120 in stage 630, method 600 may proceed to stage 640 where the user of the abdominal exercise cycling apparatus 100 may place their feet in a pedal assembly 152 and begin cycling while in a supine position. Once the user of the abdominal exercise cycling apparatus 100 may place their feet in a pedal assembly 152 and begin cycling while in a supine position in stage 640, method 600 may then end at stage 650.

Ways to implement the stages of method 600B will be described in greater detail below. Method 600B may begin at starting block 655 and proceed to stage 660 where a user 500 of the abdominal exercise cycling apparatus 100 may position themselves in a supine position interlocking fingers behind the head while actively engaging the pedaling system 152 with elbows in an outward position.

From stage 660, where a user 500 of the abdominal exercise cycling apparatus 100 may position themselves in a supine position interlocking fingers behind the head while actively engaging the pedaling system 152 with elbows in an outward position, method 600 may advance to stage 670 where a user 500 of the abdominal exercise cycling apparatus 100 may position themselves in a supine position interlocking fingers behind the head while actively engaging the pedaling system 152 with elbows in an outward position may elevate the neck and shoulders while holding a shoulder backward press assembly 200.

Once the user 500 of the abdominal exercise cycling apparatus 100 may elevate the neck and shoulders while holding a shoulder backward press assembly 200 in stage 670, method 600 may continue to stage 680 where the user 500 of the abdominal exercise cycling apparatus 100 may lower the neck and shoulders back against a resistance generated by a spring support of the shoulder backward press assembly 200.

After the user 500 of the abdominal exercise cycling apparatus 100 may lower the neck and shoulders back against a resistance generated by a spring support of the shoulder backward press assembly 200 in stage 680, method 600 may proceed to stage 690 where the user 500 of the abdominal exercise cycling apparatus 100 may hold the neck and shoulders in an elevated static position while holding the shoulder backward press assembly 200. Once the user 500 of the abdominal exercise cycling apparatus 100 may hold the neck and shoulders in an elevated static position while holding the shoulder backward press assembly 200 in stage 690, method 600 may then end at stage 695.

The foregoing disclosure provides illustration and description, but is not intended to be exhaustive or to limit the implementations to the precise form disclosed. Modifications and variations are possible in light of the above disclosure or may be acquired from practice of the implementations. As used herein, the term component is intended to be broadly construed as hardware, firmware, or a combination of hardware and software. Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, or the like. Certain user interfaces have been described herein. In some implementations, the user interfaces may be customizable by a device. Additionally, or alternatively, the user interfaces may be pre-configured to a standard configuration, a specific configuration based on a type of device on which the user interfaces are displayed, or a set of configurations based on capabilities and/or specifications associated with a device on which the user interfaces are displayed.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise."

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

The following is claimed:

1. An apparatus, comprising:

a body support portion having a body pad including an adjustable lumbar support pad, a bottom surface of the body pad secured to top surface of a base using an anti-slip component having interlocking friction texture disposed on said bottom surface of the body pad and top surface of the base;

a frame apparatus connected to the body support portion, the frame apparatus having a plurality of frame members connected to a plurality of stabilizing members and configured to hold the frame apparatus in a plurality of fixed positions; and a resistance portion having a contactless eddy brake assembly comprising:

a magnet assembly having a pair of opposing magnets, from within two-cylinder components on opposing sides of a motor in a motor box configured to contact a gear track collectively forming a gear assembly positioned between a magnetic field of the pair of opposing magnets, the magnet assembly and gear assembly positioned about a pedal assembly having a crank arm connected to a foot rest configured to propel a wheel disk in a cyclical motion.

2. The apparatus of claim 1, wherein each connected frame member and stabilizing member of the frame apparatus cooperate to provide a plurality of supporting member lengths, and a plurality of angles of activity.

3. The apparatus of claim 1, further comprising a display having a biometric digital readout screen for displaying at least one of: a user's vitals, an exercise duration, a stopwatch, a clock, a heart rate, and health information.

4. The apparatus of claim 1, the wheel disk having at least one of: a disk cover or a cooling shroud.

5. The apparatus of claim 1, the resistance portion further comprising a counterbalanced weighted resistance for use without a power supply.

6. The apparatus of claim 1, further comprising one or more extendable members attached to the pedal assembly for alternative exercise motion.

7. The apparatus of claim 1, wherein at least one fixed position of the plurality of fixed positions is one of a collapsed position, an upright position, and an acute position.

8. The apparatus of claim 1, further comprising:

a housing covering at least a portion of the frame apparatus.

9. The apparatus of claim 2, further comprising one or more extended members attached to the pedal assembly for an alternative exercise motion.

10. The apparatus of claim 1, further comprising at least one of a handle or a grip attached to the pedal assembly for alternative upper limb exercise motion.

11. The apparatus of claim 1, further comprising:

a shoulder backward press assembly having a head rest connected to a shoulder support member;

the shoulder support member having a plurality of arm supporting pads; and further supported by a spring support contacting the base portion.

12. A method, comprising:

adjusting the body support portion, of the apparatus of claim 1, to an appropriate exercise position having height and angle;

adjusting the frame apparatus, to the appropriate exercise position including securing a stabilizing member to hold the appropriate exercise position;

placing feet in the pedal assembly while placing torso in a supine position on the body support portion; and pedaling the pedal assembly with force in a cycling motion against a resistance generated by the contactless eddy braking assembly.

13. The method of claim 12, further comprising:
holding a neck and shoulders in a static position on the body support portion while pedaling continuously.

14. The method of claim 12, further comprising:
interlocking fingers behind a head while pedaling with elbows in an outward position;
elevating a neck and shoulders off of the body support portion while pedaling continuously; and
lowering the neck and shoulders back to an upper surface of the body support portion.

15. The method of claim 12, further comprising:
performing a sit-up motion at varied intervals while pedaling continuously.

16. The method of claim 12, further comprising:
holding a neck and shoulders in a static position elevated above the body support portion.

17. The method of claim 12, further comprising:
holding a neck and shoulders in a static position elevated above the body support portion at an angle between ten and ninety degrees.

18. The method of claim 12, further comprising:
interlocking fingers behind a head while pedaling with elbows in an outward position;
elevating a neck and shoulders holding a shoulder backward press assembly while pedaling continuously; and
lowering the neck and shoulders back against a resistance generated by a spring support of the shoulder backward press assembly.

19. The method of claim 18, further comprising:
holding the neck and shoulders in an elevated static position holding a shoulder backward press assembly while pedaling continuously.

20. A system, comprising:
a body support apparatus having
a body pad, secured to a base apparatus using a plurality of fasteners,
an adjustable lumbar support pad, secured to the base apparatus using a fastener;
the base apparatus disposed on a level surface, having
an anti-slip component, having a friction textured surface configured to interlock with a lower surface of the body support apparatus,
a stabilizing member, providing a rigid connection between the anti-slip component and a frame apparatus;
the frame apparatus having
an adjustable member capable of affixing the frame apparatus in at least one fixed position;
a resistance apparatus having
a contactless eddy brake unit comprising:
a magnet unit having a pair of opposing magnets, from within two-cylinder components on opposing sides of
a motor in a motor box configured to contact a gear track collectively forming a gear unit positioned between a magnetic field of the pair of opposing magnets,
the magnet unit and gear unit positioned about
a pedal unit having
a crank arm connected to
a foot rest configured to propel a wheel disk in a cyclical motion; and
a shoulder backward press unit having
a head rest connected to a shoulder support member.

* * * * *